US005558049A

United States Patent [19]

Dubose

[11] Patent Number: 5,558,049

[45] Date of Patent: Sep. 24, 1996

[54] VARIABLE ORBITAL APERTURE VALVE SYSTEM FOR FLUID PROCESSING MACHINES

[76] Inventor: G. Douglas Dubose, 2712 56th St., Lubbock, Tex. 79413

[21] Appl. No.: 462,489

[22] Filed: Jun. 5, 1995

[51] Int. Cl.[6] ..... F01L 7/00

[52] U.S. Cl. ..... 123/80 D; 123/190.14

[58] Field of Search ..... 123/80 D, 190.14, 123/80 R, 80 BA, 80 BB, 80 C, 190.1, 190.12, 190.2

[56] References Cited

U.S. PATENT DOCUMENTS

| | | | |
|---|---|---|---|
| 1,140,206 | 5/1915 | Swackhammer . | |
| 1,188,656 | 6/1916 | Hoff . | |
| 1,212,488 | 1/1917 | Hughes | 123/190.14 |
| 1,227,698 | 5/1917 | Tibbetts | 123/190.14 |
| 1,282,602 | 10/1918 | Lindstrom . | |
| 1,692,396 | 11/1928 | Tipton . | |
| 1,751,986 | 3/1930 | Flescher . | |
| 2,257,846 | 10/1941 | Horstman . | |
| 2,283,594 | 5/1942 | Aspin . | |
| 2,288,774 | 7/1942 | Beckman | 123/80 D |
| 2,369,147 | 2/1945 | Klas . | |
| 2,444,696 | 7/1948 | Dela Riestra et al. . | |
| 2,648,318 | 8/1953 | Bensinger | 123/80 D |
| 2,787,988 | 4/1957 | Genet . | |
| 2,975,774 | 3/1961 | Coffey et al. . | |
| 3,130,953 | 4/1964 | Carpenter . | |
| 3,990,423 | 11/1976 | Cross et al. | 137/625.22 |
| 4,077,382 | 3/1978 | Gentile | 123/80 BA |
| 4,418,658 | 12/1983 | DiRoss | 123/80 D |
| 4,473,041 | 9/1984 | Lyons et al. | 123/80 BA |
| 4,517,938 | 3/1985 | Kruger | 123/190.1 |
| 4,545,337 | 10/1985 | Lyons et al. | 123/80 BA |
| 4,815,428 | 3/1989 | Bunk . | |
| 5,284,116 | 2/1994 | Richeson | 123/90.11 |
| 5,367,999 | 11/1994 | King et al. | 123/458 |

FOREIGN PATENT DOCUMENTS

| | | | |
|---|---|---|---|
| 508257 | 10/1920 | France | 123/190.14 |
| 1311858 | 11/1962 | France | 123/190.14 |
| 2542814 | 9/1984 | France | 123/190.14 |
| 165223 | 7/1949 | Germany | 123/80 D |
| 2545289 | 6/1977 | Germany | 123/190.14 |
| 3326714 | 2/1985 | Germany | 123/80 D |
| 58-220911 | 12/1983 | Japan | 123/80 D |
| 3-253709 | 11/1991 | Japan | 123/80 D |
| 6-66118 | 3/1994 | Japan | 123/80 D |
| 22241 | 7/1910 | United Kingdom | 123/190.14 |

OTHER PUBLICATIONS

Internal Combustion Engine Fundamentals, John B. Heywood, McGraw-Hill Book Co., pp. 223–225 Dated Jan. 1988.

*Primary Examiner*—David A. Okonsky
*Attorney, Agent, or Firm*—Peter D. Keefe

[57] ABSTRACT

A valve system for fluid processing machines which provides fully dynamic control over aspiration events. In the case of an internal combustion engine application, the variable orbital aperture valve system includes a rotary valve in the form of an "orbiter" disc having primary intake and exhaust apertures provided therein for sealing with the head of the combustion chamber and periodically aligning with intake and exhaust ports therein to thereby periodically aspirate the combustion chamber. The orbiter is connected by a linkage to the crank shaft of the internal combustion engine, and turns at typically one-half the crank shaft speed. The variable orbital aperture valve system further includes at least one "floater" disc having a secondary aperture therein which, depending upon the selected placement of the secondary aperture with respect to the respective intake or exhaust port, the aforesaid alignment with the primary intake or exhaust aperture of the orbiter is thereby modified. The selected position of the secondary aperture with respect to a respective intake or exhaust port is effected by a stepper motor turning the floater a selected number of degrees under computer control, such as for example by the ECM. The orbiter is sealed with respect to the one or more floaters, and the orbiter and the one or more floaters are collectively sealed with respect to the head.

32 Claims, 13 Drawing Sheets

VARIABLE ORBITAL APERTURE VALVE SYSTEM FOR FLUID PROCESSING MACHINES

BACKGROUND OF THE INVENTION

1. Field of the invention

The present invention relates to valve systems for regulating aspiration events for fluid processing machines, such as for example internal combustion engines, compressors and pumps. More particularly, the present invention relates to rotary valve systems for regulating fluid intake and exhaust events of machines of the aforesaid type. Still more particularly, the present invention relates to a rotary valve system having a rotating orbiter disc having apertures therein for providing periodic alignments with intake and exhaust ports of the aforesaid type of machine, and one or more floater discs which provide selective modification of one or both the aforesaid alignments.

2. Description of the Related Art

All fluid processing machines, including machines operating on the basis of periodic compression of gases to provide mechanical energy, such as gasoline and diesel internal combustion engines, machines using mechanical energy to provide compression of gases, such as compressors for refrigeration, and machines using mechanical energy to move fluids, such as hydraulic pumps, require precise valve event regulation in order to function properly. The valves commonly used to provide control of the valve events are generally of two major conventional classes, poppet valves and rotary valves.

Poppet valves conventionally have a tapered ("mushroom" shaped) valve head connected with a rod. The rod is resiliently biased to abut a cam on a rotating cam shaft which causes the rod to periodically reciprocate in proportional to the speed of revolution of a drive shaft of the machine. Rod reciprocation provides movement of the valve head with respect to a seat formed at its respective port. When in its closed position, the valve head sealingly abuts the seat of the port, otherwise the valve head is separated from the seat, whereupon aspiration of a chamber fluidically communicating with the port is made possible.

While poppet valves are reliable, the valve head thereof tends to obstruct the port even when at a position furthest from the seat. The inherent collation of poppet valves also renders them difficult to keep cool. Poppet valves also generally require a variety of subcomponents, such as springs, guides, retainers, actuators, and seals. Also, the reciprocational movement of poppet valves introduces valve harmonics and valve "float" and limits valve response time, and consequently, engine speed and engine efficiency. Accordingly, in situations where poppet valves are inherently detrimental to efficient operation of the machine, rotary valves are an alternative.

Rotary valves are conventionally configured in the form of either a disc (as for example described in U.S. Pat. No. 4,418,658) or a cylinder (as for example described in U.S. Pat. No. 4,815,428), wherein the rotary valve rotates with respect to each seat of one or more ports of the machine. The rotary valve is provided with one or more apertures which, as the rotary valve rotates via a drive connected in time with the drive shaft of the machine, periodically align with a respective seat of one or more ports of a chamber of the machine. Whenever alignment occurs, the respective port and rotary valve aperture provide unobstructed aspiration of the chamber.

While fluid processing machines cover a wide variety of mechanisms, of particular interest is the internal combustion engine because it has become a world-wide ubiquitous source of motive power. Internal combustion engines may be of a reciprocating piston type or of a rotating piston type, wherein the reciprocating piston type is by far the most common of the two, principally because of its superior durability and relative ease of sealing. Internal combustion entries operate conventionally on either the Otto cycle (spark ignition) or the Diesel cycle (compression ignition).

The reciprocating internal combustion engine includes one or more piston-cylinder combinations which provide a combustion chamber for reciprocally driving the piston during combustion of an air/fuel mixture gas. The reciprocating internal combustion engine includes a block for providing placement of the one or more cylinders and for providing a mechanical linkage for converting reciprocation of the one or more pistons to rotation of a crank or drive shaft. The reciprocating internal combustion engine further includes a head connected with the block which provides a blind end of each cylinder that in part defines the combustion chamber thereof. Two or more ports for aspirating each combustion chamber are provided at the head, and a spark plug, with its associated ignition system, is provided with Otto cycle reciprocating internal combustion engines. In this regard, an intake manifold is connected with the head at one or more intake ports which provide air and, via fuel injectors or a carburetor, fuel into the combustion chamber; and an exhaust manifold is connected with the head at one or more exhaust ports which direct combusted gases from the combustion chamber.

Further, reciprocating internal combustion engines may operate on a four stroke or a two stroke cycle of operation.

Conventional four stroke cycle (Otto cycle) operation is schematically described as follows:

a) during an "intake stroke" the crank shaft revolves from 0 to 180 degrees, the exhaust port valve remains closed and the intake port valve is opened whereby the air/fuel gas mixture enters the combustion chamber as the piston descends from top dead center to bottom dead center;

b) during a "compression stroke" the crank shaft revolves from 180 to 360 degrees, the exhaust port valve remains closed and the intake port valve is closed whereupon the air/fuel gas mixture is compressed in the combustion chamber as the piston ascends from bottom dead center to top dead center;

c) during a "power stroke" the crank shaft revolves from 360 to 540 degrees, the exhaust port valve and the intake port valve remain closed whereupon the air/fuel gas mixture is ignited by the spark plug whereby the expansion of the gas causes the piston to descend from top dead center to bottom dead center; and d) during an "exhaust stroke" the crank shaft revolves from 540 to 720 degrees, the intake port valve remains closed and the exhaust port is opened whereby the combusted air/fuel gas mixture leaves the combustion chamber as the piston ascends from bottom dead center to top dead center, whereupon the cycle repeats.

Of course, valve events may overlap and ignition timing may be advanced or retarded in order to fulfill one or more operational criteria of a particular engine.

Conventional two stroke cycle operation (having positive inlet pressure scavenging) is schematically described as follows:

a) during a first stroke the, crank shaft revolves from 0 to 180 degrees; as the piston ascends from bottom dead center, the air/fuel gas mixture enters under positive pressure into the cylinder via an open inlet port near bottom dead center whereby combusted gas within the cylinder is scavenged out an open exhaust port located further from bottom dead center than is the inlet port; as the piston ascends further, the inlet port is closed, and as the piston ascends still further, the exhaust port is closed; now compression of the air/fuel mixture gas occurs in the cylinder until the piston reaches top dead center; and b) during a second stroke the crank shaft revolves from 180 to 360 degrees; a spark plug ignites the air/fuel mixture gas, whereupon the expansion of the gas causes the piston to descend; as the piston descends the exhaust port is opened and the combusted gas in part exits the cylinder through the exhaust port; as the piston reaches bottom dead center, the inlet port is opened, whereupon air/fuel mixture gas enters the cylinder and scavenges out the remaining combustion gas; the piston reaches bottom dead center, whereupon the cycle repeats.

Again, valve events and ignition timing my be timed otherwise in practice.

The four stroke cycle has the advantage of providing positive scavenging during the exhaust stroke, while the two stroke cycle has the advantage that each revolution of the crank shaft involves a power stroke.

Internal combustion engines are increasingly becoming subject to ever more stringent regulations concerning maximum acceptable pollutant emissions and minimum acceptable efficiency, while at the same time providing an acceptable level of output power and reasonable cost of production and operation.

Over the last quarter century, a proliferation of regulations, oil supply vulnerability, manufacturer competition, and increasing consumer sophistication have been driving forces behind ever improving engine technology. For example, today, as compared to twenty-five years ago, fuel efficiency has approximately doubled, and pollutant emissions ($NO_x$, CO and HC) have been reduced by between seventy-five and ninety-five percent.

While increased fuel economy in vehicular applications is in some measure the result of reduced vehicle weight and aerodynamic vehicle design, in large measure improved fuel economy and reduced pollutant emissions are the result of electronic control over engine operation. In this regard, computer control of engine function is provided by an engine control module (ECM), wherein the ECM is provided with a number of sensors which serve to monitor various engine parameters, such as coolant temperature, engine speed, intake manifold pressure, intake air temperature, throttle position, as well as oxygen level in the exhaust to determine, and thereupon provide, instantaneous engine adjustments.

The ECM provides a basis for electronic fuel injection, which is far superior to carbureted fuel metering in that exactly the right fuel to air mixture is provided with each combustion stroke. The ECM further provides a basis for electronic ignition spark timing which is far superior to mechanical ignition systems because advancing or retarding of the spark is easily effected to thereby instantaneously adjust the combustion stroke in accord with engine operational conditions. Indeed, the ECM can adjust the fuel and spark timing dynamically to each combustion chamber, thereby reducing or eliminating "knock", maximizing operating efficiency and minimizing pollutant emissions.

While dynamic control over fuel injection and spark timing are known and in widespread use today, there has been little done to implement dynamic control over valving. To date, most efforts in this regard have involved a drive linkage system which varies the rotation of a poppet valve cam shaft between two settings: retard and advance, which does not provide true dynamic control over valving.

Accordingly, what is needed in the art of fluid processing machines is fully dynamic control over valve events, including, duration and centerline thereof.

SUMMARY OF THE INVENTION

The present invention is a valve system for fluid processing machines which provides fully dynamic control over valve events, including timing, duration and centerline thereof, as well as effective port area and effective port shape. While the present invention relates to any fluid processing machine, the embodiment chosen for the disclosure thereof will be with respect to reciprocating internal combustion engines for purposes of exemplification and not limitation.

The variable orbital aperture valve system according to the present invention includes a rotary valve in the form of a primary disc, hereinafter referred to as an "orbiter" having primary intake and exhaust apertures provided therein for sealing with the head and periodically aligning with intake and exhaust ports therein to thereby periodically aspirate the combustion chamber. The orbiter is connected by a linkage to the crank (or drive) shaft of the internal combustion engine, and turns at typically one-half the crank (or drive) shaft speed. The variable orbital aperture valve system according to the present invention further includes at least one secondary disc, hereinafter referred to as a "floater" having a secondary aperture therein which, depending upon the selected placement of the secondary aperture with respect to the respective intake or exhaust port, the aforesaid alignment with the primary intake or exhaust aperture of the orbiter is thereby modified. The selected position of the secondary aperture with respect to a respective intake or exhaust port is effected by an actuator, such as for example a stepper motor, turning the floater a selected number of degrees under computer control, such as for example by the ECM. The orbiter is sealed with respect to the one or more floaters, and the orbiter and the one or more floaters are collectively sealed with respect to the head.

While a nearly limitless arrangement of floaters, orbiters and combustion chamber exhaust and intake ports can be imagined, three primary exemplifications are worthy of note:

a) a head having a single intake port and a single exhaust port, an orbiter with a single primary exhaust aperture and a single primary intake aperture, and a single floater having a secondary aperture located at the intake port;

b) a head having a single intake port and a single exhaust port, an orbiter with a single primary exhaust aperture and a single primary intake aperture, and dual floaters, each having a secondary aperture located at the intake port; and c) a head having a single in take port and a single exhaust port, an orbiter with a single primary exhaust aperture and a single primary intake aperture, and two floaters, one floater having a secondary aperture located at the exhaust port, and the other floater having a secondary aperture located at the intake port.

In general, the variable orbital aperture valve system according to the present invention is in the form of an original or retrofit aspiration control component of a fluid processing machine, wherein the machine has at least one fluid processing chamber, each chamber having at least one port through which fluid passes into and out of the chamber, wherein the variable orbital aperture valve system is characterized as:

an orbiter having at least one primary aperture therein; means for mounting the orbiter adjacent a chamber of the fluid processing machine to thereby mount the orbiter rotatably with respect to the chamber in sealingly interfaced relation with respect to the at least one port;

means for rotating the orbiter with respect to the chamber to thereby provide periodic alignment of the at least one primary aperture with respect to the at least one port;

at least one floater having a secondary aperture therein;

means for mounting the at least one floater adjacent the orbiter to thereby mount the at least one floater movably in sealingly interfaced relation with respect to said orbiter and the at least one port; and means for selectively moving the at least one floater with respect to the at least one port so that the secondary aperture is selectively aligned with respect thereto;

wherein fluid passes through the at least one port when the at least one primary aperture of the orbiter aligns therewith, and wherein the alignment of the at least one primary aperture with respect to the at least one port is selectively modified by the selective movement of the at least one floater due to repositioning of the at least one secondary aperture thereof with respect to the at least one port.

Further, the variable orbital aperture valve system according to the present invention preferably includes a computerized control system (fancifully referred to herein as a "software cam") for controlling selective movement of the one or more floaters, characterized by:

actuator means for selectively moving the at least one floater with respect to the at least one port; and computer control means for controlling actuation of the actuator means to thereby selectively align the secondary aperture with respect to the at least port responsive to selected operating conditions of the machine.

The orbiter and the floaters are preferably constructed of a wear resistant metal, ceramic or metal coated ceramic. Adequate sealing and inherent lubrication are provided, for example, by an interface of ceramic surfaces with respect to carbon impregnated metal surfaces. In this regard, the materials selected for all wearing surfaces of the orbiter, floaters, and head, must be corrosion resistant, have a low coefficient of friction, and have high strength even when hot. Materials can include ceramics, oxide ceramics, carbides, nitrides, and "superalloys" having a predominately nickel composition.

The orbiter is driven by a gear arrangement connected with the crank shaft, wherein the rotation speed of the orbiter is typically one-half the crank shaft speed; however, the rotation speed of the orbiter may be different, depending for example on the number of intake and exhaust ports in the head and/or whether the engine is operating on four or two cycle operation. In the case of a retrofit installation, the cam shaft location can be used to provide a main orbiter drive shaft, from which individual orbiter drive shafts are drivingly engaged to thereby drive each orbiter by respective meshing engagement with a toothed periphery thereof. The orbiter may be supported by a center pivot or by a sealing surface near its periphery. The orbiter can be concentric with the cylinder or it can be offset to allow space for a conventional spark plug and possibly for an in-cylinder fuel injector. With the orbiter supported at the edge thereof, the center can be left open to provide access for the spark plug and/or a fuel injector. The orbiter can rotate in a plane perpendicular to the cylinder axis or it can be positioned at an arbitrary angle to the cylinder axis. The orbiter may be flat or provided with any surface of revolution, such as a cup shape. While an orbiter with a curvature may be more difficult to fabricate than a flat one, it would have the advantage of stiffness and thereby provide a potentially better seal under high pressure conditions.

There are at least two basic primary aperture configurations for the orbiter. In a first configuration, the primary exhaust aperture is located adjacent the axis of rotation of the orbiter, while the primary intake aperture is located further from the axis of rotation; the intake and exhaust ports are similarly located so that the primary intake and exhaust apertures uniquely align respectively with the intake and exhaust ports and a circular seal prevents commingling of the gases therebetween. In a second configuration, the orbiter is provided with a single primary aperture which serially aligns with the intake and exhaust ports; due to sealing requirements to prevent gas commingling, this configuration may be best suited for high performance engines.

In certain fluid processing machines there may be more or less than two ports for aspiration. Indeed, at a minimum, the fluid processing chamber of the machine could have only one port for periodic aspiration, the orbiter could have only one primary aperture and would rotate at a speed appropriate to provide the necessary periodicity of port alignment for correctly timed intake and exhaust aspiration, and the floater could have one secondary aperture selectively positionable with respect to the single port.

The floaters are located either above, below, or both above and below the orbiter. The floaters preferably move rotatably, but may rather move linearly or otherwise move, either side of a centerline position; with respect to rotative movement, typically only a few degrees either side of the centerline is necessary. By rotating the floater to thereby relocate the secondary aperture with respect to either the intake or exhaust port, the alignment of the respective primary aperture of the orbiter with the port is altered. Alteration of alignment can include adjustment of the port area and shape, valve event duration, valve event timing (opening and/or closing), the centerline of the valve event, and overlap of the valve event with respect to adjacent stroke portions of the cycle. The floaters can be dynamically controlled by the ECM using one or more stepper motors or other electric or pneumatic actuators. Production internal combustion engines would typically have one intake port floater, whereas developmental engines may have one or two floaters on each of the intake and exhaust ports so as to provide fine-tune adjustment of operation of a particular engine, whereupon a single floater would be installed at the intake port on the optimized production version of the particular engine.

Because the floaters are controlled by the ECM, a software instruction, which as mentioned hereinabove is fancifully referred to herein as a "software cam", is stored in memory thereof to thereby effect floater movement in response to sensed engine conditions, and provide a wide range of performance options.

The variable orbital aperture valve system according to the present invention allows for the head of the internal combustion engine to be made very light and compact, and practical problems associated with placement of head bolts, cooling passages, and intake and exhaust manifolds are minimal. Further, the shape of the combustion chamber is not limited or dictated by the variable orbital aperture valve system according to the present invention. For example, curved orbiters and floaters can economically define a hemispherically shaped combustion chamber; or, alternatively, a flat orbiter and floaters can be used in a case where the combustion chamber is formed in the top of the piston. Further, it is possible for the head not to require liquid cooling, since the predominate mass thereof will be in intimate contact with the block and its associated water passages (the lower head and block could even be formed of a single casting). In this regard further, the orbiter is able to dissipate heat through the intimate and large surface contact area of its sealing surfaces, as well as through the optional center pivot. The periphery of the orbiter can also serve as a cooling location. In the event additional cooling is required, water passages and/or oil passages in the orbiter may be provided.

Elimination of a throttle due to the variable orbital aperture valve system according to the present invention will reduce engine pumping losses. For example, air flow into the combustion chamber is controllable by shortening the time the intake port valve is open, rather than increasing the pressure drop in the intake system of the engine. During low power and idle conditions, the variable orbital aperture valve system according to the present invention can provide a very small effective area of the intake port which will provide high velocity (even perhaps supersonic) airflow into the combustion chamber. In this regard, supersonic air flow into the cylinder during idle can greatly reduce both fuel consumption and pollutant emission.

Exhaust gas recirculation (EGR) can be effected with the variable orbital aperture valve system according to the present invention by reopening the exhaust port during the intake stroke. Accordingly, overall emissions can be greatly improved by increased control over aspiration of the combustion chamber.

Engine power output can be tailored to specific driving conditions by dynamically controlling valve events using the variable orbital aperture valve system according to the present invention to thereby provide an essentially constant torque curve over a wide range of engine speed.

The variable orbital aperture valve system according to the present invention can serve to periodically cover the spark plug and/or fuel injector. In this regard, the orbiter can be provided with an appropriately located tertiary aperture which periodically aligns with the spark plug and/or the fuel injector at the time that device is to be operated. In this respect, the device can be covered during the combustion stroke and thereby spared from exposure to the high temperature and pressure associated therewith. Indeed, usage of non-conventional spark plugs might provide further advantages. A conventional low pressure fuel injector could be used to provide direct, in-cylinder fuel injection, yet by virtue of periodic coverage by the orbiter, the fuel injector is protected from the harsh environment of the combustion process. For example, if fuel injection occurs early in the compression stroke, the combustion chamber pressure is then low and would obviate need of a high pressure fuel injector, as is typical of most direct fuel injection processes. Direct fuel injection would thus be accomplished inexpensively and could potentially significantly reduce pollutant emissions.

The variable orbital aperture valve system according to the present invention can function with either a two stroke cycle of operation, a four stroke cycle of operation, or switchably therebetween. Switching between cyclical modes of operation is simply accomplished by optionally changing the orbiter speed of rotation and/or selectively uncovering additional ports in the head by movement of one or more floaters and the ECM switching to an appropriate operation control and ignition program stored therein. For example, in following the two-stroke cycle recounted hereinabove, an exhaust port floater can uncover an additional length of the exhaust port, while an intake port floater can shorten the length of the intake port to thereby collectively simulate the valving events recounted hereinabove, with the orbiter rotating at double speed (one-to-one with the crank shaft) by a simple gear shift at its drive shaft. In the event appropriate ports and apertures are provided, and the ECM is provided with the appropriate operation mode programs, the engine can be dynamically switched from four stroke cycle operation to two stroke cycle operation and vice versa while running. In this respect the aforementioned low pressure fuel injector would be useful to reduce pollutant emissions during two stroke cycle operation. Further, scavenging could be accomplished with air only, thus no raw fuel would be released into the exhaust manifold.

The aforementioned "software cam" allows the valve events to be dynamically controlled while the engine is running to thereby continuously optimize engine performance and minimize pollutant emissions. Accordingly, while the engine is running, operation characteristics can be changed based upon programmed configurations of optimal performance, based upon engine operation conditions and even alternative fuels.

It is possible to even modify the compression ratio while the engine is running, which, in conjunction with dynamic valve event timing would provide an extremely efficient, clean burning, multi-fuel engine. In this regard, the combustion chambers would be designed to operate at a high compression ratio, with lesser compression ratios being possible by varying the valve events.

The variable orbital aperture valve system according to the present invention can allow for the lower head and block to be cast as one piece, thereby reducing manufacturing costs, increasing combustion chamber strength with associated allowance for increased combustion chamber pressures, arid improved heat transfer from the variable orbital aperture valve system and reduction of tendency toward "knock" associated with low octane fuels and high compression ratios.

Finally, because of the preferred ceramic based material and the increased heat transfer from the variable orbital aperture valve system, an approximation of adiabatic operating conditions is possible.

Accordingly, it is an object of the present invention to provide aspiration of a fluid processing machine via a rotary valve system which provides periodic valve events and further provides selective alteration of one or more of the periodic valve events.

It is a further object of the present invention to provide an internal combustion engine equipped with a variable orbital aperture valve system having at least a number of the following advantages:

a) independent and dynamic control of aspiration of the combustion chamber, including the effective intake and or exhaust port area and/or shape, which may include obviation of a throttle plate;

b) independent and dynamic control of intake and/or exhaust valve event timing;

c) independent and dynamic control of intake and/or exhaust valve event duration;

d) independent and dynamic control of intake and/or exhaust valve event overlap;

e) improved heat dissipation from the valve components;

f) complete dynamic ECM control of valve events;

g) ability to change from two stroke cycle operation to four stroke cycle operation and vice versa;

h) ability to adjust the engine to accommodate an alternative fuel without hardware modifications;

i) ability to periodically "hide" the spark plug and/or fuel injector from the combustion chamber;

j) reduction of the number of required parts associated with valving;

k) compression braking can be easily effected as needed;

l) individual cylinders may be "shut-down" as needed, and which cylinders are shut down can be rotated; for example, an engine may operate on six cylinders but to pass or go uphill it may operate on eight cylinders;

m) engine weight and size are minimized;

n) ability to work with engines operating on the Otto cycle (spark ignition) or Diesel cycle (compression ignition);

o) fewer and lighter parts with lower inertial forces as compared with poppet valve systems;

p) absence of valve "float" or harmonics, and absence of possibility for the piston to strike the orbiter and/or the floaters;

q) the engine compression ratio can be changed while the engine is running; and r) ability to self-test and balance the combustion chambers to provide smooth, efficient and clean operation.

These, and additional objects, advantages, features and benefits of the present invention will become apparent from the following specification.

DETAILED DESCRIPTION OF THE PREFERRED EMBODIMENTS

Figure 1:
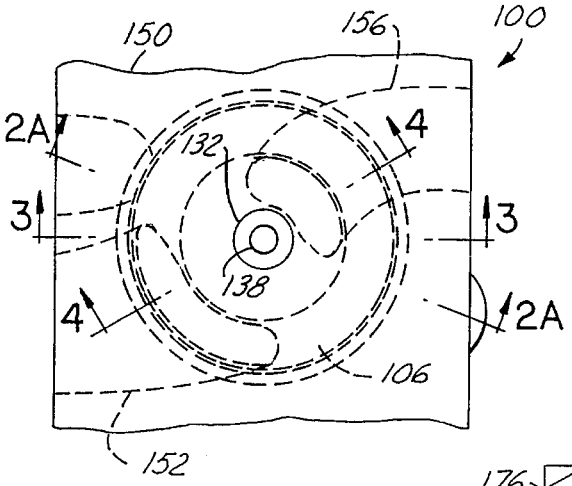
FIG. 1 is a top plan view of a head assembly of an internal combustion engine equipped with the variable orbital aperture valve system according to the present invention, wherein one floater is provided at the intake port.

As indicated hereinabove, the variable orbital aperture valve system according to the present invention is applicable generally to fluid processing machines, wherein periodic valve events are utilized as an integral part of the operation thereof. Such machines include, but are not limited to, internal combustion engines, gas compressors and pumps for liquids and gases.

In order to exposit the general principles of valving under operation of the variable orbital aperture valve system according to the present invention, the following detailed description shall be directed, by way of exemplification and not limitation, to three exemplary embodiments of a reciprocating internal combustion engine equipped with the variable orbital aperture valve system according to the present invention, wherein, expectantly, those having ordinary skill in the engineering art are enabled, using as a guide the disclosure enunciated hereinbelow, to adroitly adapt the variable orbital aperture valve system according to the present invention to operably interface with other machines, such as for example other forms of internal combustion engines, compressors and pumps.

Example I will be recounted in greatest detail, so that like-functioning parts of remaining Examples II and III will have like numeral designations, and, unless warranted, a detailed redescription thereof is not essential to a full and complete understanding thereof. In each example, while one combustion chamber is shown, it is to be understood that any one engine may have a number of combustion chambers, each having an associated variable orbital aperture valve system according to the present invention.

Example I: Orbiter with Single Floater at the Intake Port

Referring now to the Drawing, FIGS. 1 through 4 depict an exemplary head assembly 100 of a reciprocating internal combustion engine which is equipped with a variable orbital aperture valve system 102 according to the present invention. The head assembly 100 includes a lower head 110, and upper head 150, an orbiter 104 and a single floater 106 located at the intake port 108 of the head 110. The orbiter 104 rotates with respect to the upper and lower heads and the floater 106 is selectively rotatably movable with respect to the upper and lower heads. The lower head 110 has an exhaust port 112 and also has the aforementioned intake port 108 to thereby provide periodic aspiration of a combustion chamber 114, timed according to the reciprocation of the piston 116 in the cylinder 118. The aforesaid aspiration is determined by a primary intake aperture 120 in the orbiter 104 periodically aligning with the intake port 108 and by a primary exhaust aperture 122 in the orbiter periodically aligning with the exhaust port 112. The floater 106 is provided with a secondary aperture 124 which is selectively positionable with respect to the intake port 108 by rotative movement thereof. Accordingly, the aforementioned alignment of the primary intake aperture 120 of the orbiter 104 with the intake port 108 is modifiable even while the engine is running by selected positioning of the secondary aperture 124 of the floater 106 with respect to the intake port.

Figure 2B:
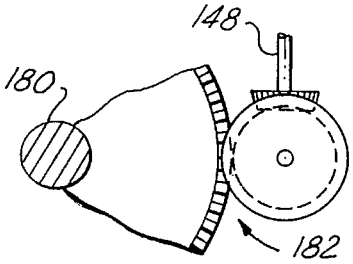
FIG. 2B is a partly broken away side view of a drive mechanism for the orbiter according to the present invention.
Figure 2A:
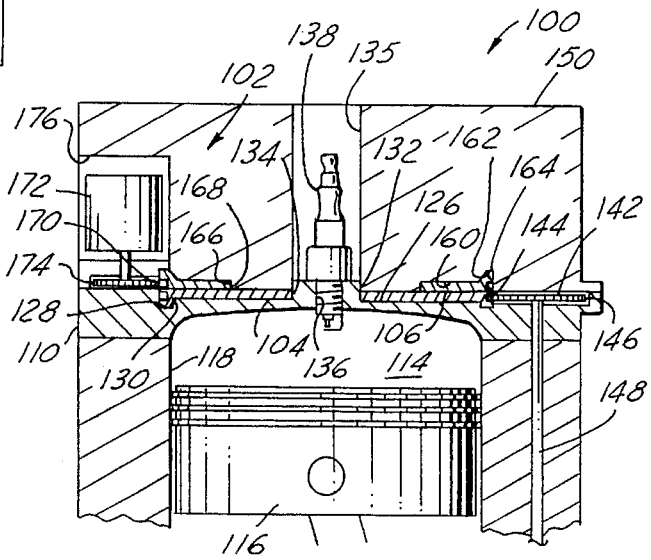
FIG. 2A is a partly broken away, partly sectional side view of the internal combustion engine, seen along line 2A—2A in FIG. 1.
Figure 5:
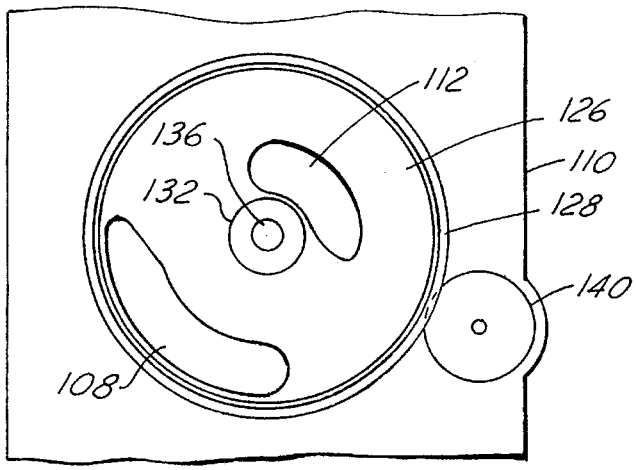
FIG. 5 is a top plan view of the lower head of the internal combustion engine of FIG. 1.

FIG. 5 depicts a plan view of the lower head 110. The depicted intake port 108 and exhaust port 112 are by way of example only and the shape and placement thereof may be varied for engineering reasons. The lower head 110 has an orbiter seat 126 which is recessed an amount that approximates the thickness of the orbiter 104 (see FIG. 2A). An annular groove 128 is provided at the periphery of the orbiter seat 126 for sealingly receiving therein an annular lip 130 of the orbiter 104 which is located at the periphery thereof (see FIG. 2A). An orbiter boss 132 is centrally located in the orbiter seat 126 for sealingly guiding the orbiter 104 at a boss hole 134 centrally located therein (see FIG. 2A). A threaded spark plug hole 136 is provided in the lower head 110 centrally with respect to the orbiter boss 132 for threadably receiving therein a spark plug 138, as depicted in FIG. 2A. Finally, an orbiter drive gear recess 140 is provided in the lower head 110 adjacent the annular groove 128 so that an orbiter drive gear 142 may be located thereat and gearingly mesh with teeth 144 on the periphery of the orbiter 104 (see FIG. 2A).

Figure 6:
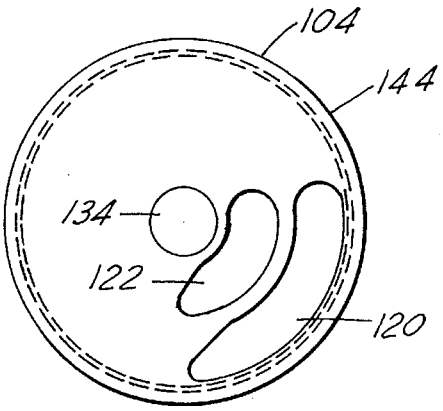
FIG. 6 is a top plan view of the orbiter of the variable orbital aperture valve system of FIG. 1.

As depicted by FIG. 6, the orbiter 104 has the aforementioned primary intake and exhaust apertures 120, 122, which are depicted by way of example only, and the shape and placement thereof may be varied for engineering reasons. As further indicated by reference to FIGS. 2A, 3 and 4, the orbiter 104 is configured to sealingly seat abuttably against the orbiter seat 126, wherein the annular lip 130 thereof is sealingly and guidingly received in the annular groove 128, and wherein the teeth 144 thereof are located so that the orbiter drive gear 142 gearingly meshes therewith. Also, as indicated hereinabove, the boss hole 134 of the orbiter 104 is guidingly interfaced with the orbiter boss 132. The placement of the primary intake aperture 120 is such that it will periodically align with the intake port 108 once with each revolution of the orbiter 104. The placement of the primary exhaust aperture 122 is such that it will periodically align with the exhaust port 112 once with each revolution of the orbiter 104.

The orbiter drive gear 142 is located in the orbiter drive gear recess 140 and has teeth 146 on its periphery which gearingly mesh with the teeth 144 on the periphery of the orbiter. The orbiter drive gear 142 is connected to an orbiter drive gear shaft 148 which is rotatably driven by any known mechanism. While a computer controlled electric motor could suffice for this purpose, preferably the orbiter 104 is driven by a connection to the crank shaft 180 such as by a gear linkage 182 as shown by FIG. 2B, whereby the rotation of the crank shaft, which rotation is directly related to reciprocation of the piston 116, directly determines rotation of the orbiter drive gear shaft, which in the present example is one-half the rotation speed of the crank shaft. Accordingly, for two rotations of the crank shaft, the orbiter 104 makes one revolution, and the intake and exhaust ports 108, 112 are respectively aligned with the primary intake and exhaust apertures 120, 122 one time each thereduring.

As will be appreciated from FIGS. 1 through 4, the upper head 150 is removably connected to the lower head 110, such as by bolting, whereby the orbiter 104, the floater 106, and associated components may be installed and serviced. The upper head 150 also provides a conduit for an intake manifold 152 and intake manifold port 154 thereof which is positioned directly opposite the intake port 108 and is shaped identically therewith. The upper head 150 further provides a conduit for an exhaust manifold 156 and exhaust manifold port 158 thereof which is positioned directly opposite the exhaust port 112 and is shaped identically therewith. An access cavity 135 is provided therein for the spark plug 138.

Figure 3:
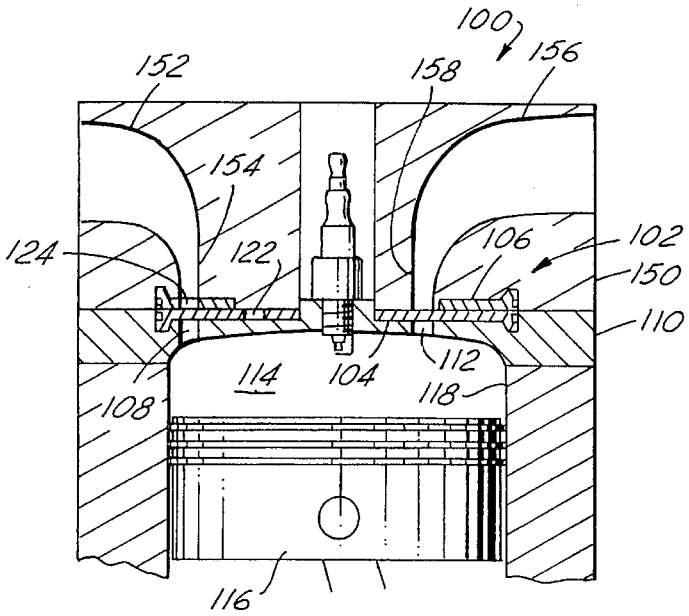
FIG. 3 is a partly broken away, partly sectional side view of the internal combustion engine, seen along line 3—3 in FIG. 1.
Figure 4:
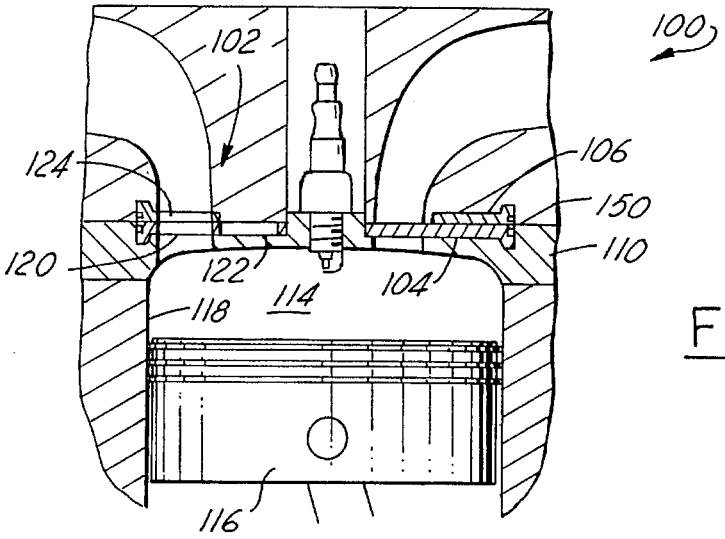
FIG. 4 is a partly broken away, partly sectional side view of the internal combustion engine, seen along line 4—4 in FIG. 1.
Figure 7:
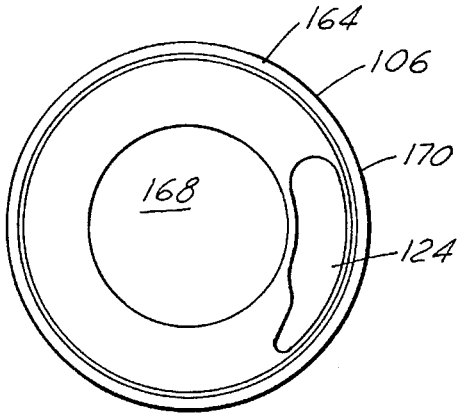
FIG. 7 is a top plan view of the floater of the variable orbital aperture valve system of FIG. 1.

As shown by FIG. 7, the floater 106 is provided with the aforesaid secondary aperture 124, which is depicted by way of example only wherein the shape and placement thereof may be varied for engineering reasons. As shown in FIGS. 2 through 4, the upper head 150 is provided with a floater seat 160 which is recessed an amount that approximates the thickness of the floater 106. An annular groove 162 is provided at the periphery of the floater seat 160 for sealingly receiving therein an annular lip 164 of the floater 106 which is located at the periphery thereof. A floater boss 166 centrally defines the inner limit of the floater seat 160 for sealingly guiding the floater 106 at a boss hole 168 centrally located therein. Seating, sealing and guiding of the orbiter 104 and the floater 106 are mutually analogous, so that further explanation of the fit of the floater 106 to the upper head 150 is therefore obviated, except to point out that the floater 106 and the orbiter 104 are mutually sealingly abutted with respect to each other, and the head 110 and the upper head 150 are collectively mutually sealingly abutted with respect to the orbiter 104 and floater 106.

The floater 106 is provided with teeth 170 at the periphery thereof. An actuator, preferably in the form of an electrically powered stepper motor 172, includes a floater drive gear 174 which gearingly meshes with the teeth 170 of the floater 106. The stepper motor 172 (or other actuator) is located in an actuator recess 176 provided in the upper head 150, and is operably controlled by a computerized control system 400 schematically shown by way of example in FIG. 47, the nature of which being detailed hereinbelow.

As indicated hereinabove, the secondary aperture 124 is shaped and positioned so as to be alignable over the intake port 108, and selectively render the intake port open or partially occluded depending upon movement of the floater 106 with respect thereto by actuation of the stepper motor 172.

Figure 8:
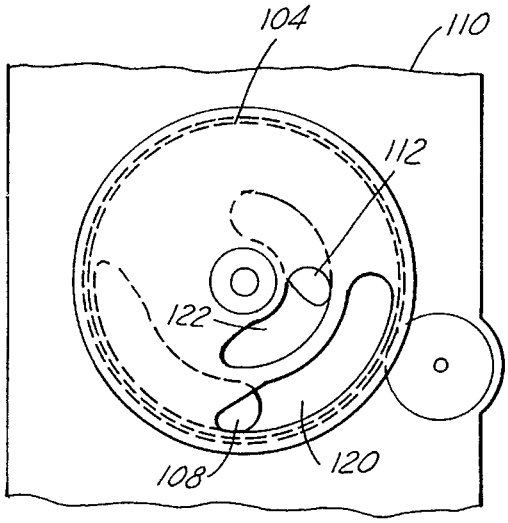
FIG. 8 is a top plan view of lower head and the orbiter of the variable orbital aperture valve system of FIG. 1, wherein the orbiter is shown in a first position.
Figure 9:
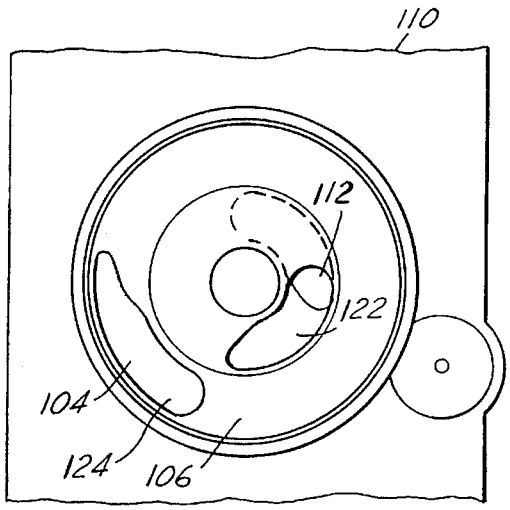
FIG. 9 is a top plan view of the lower head, orbiter and floater of the variable orbital aperture valve system of FIG. 1, wherein the orbiter is shown at the first position and the floater is shown at a first position at a first side of the intake port.
Figure 10:
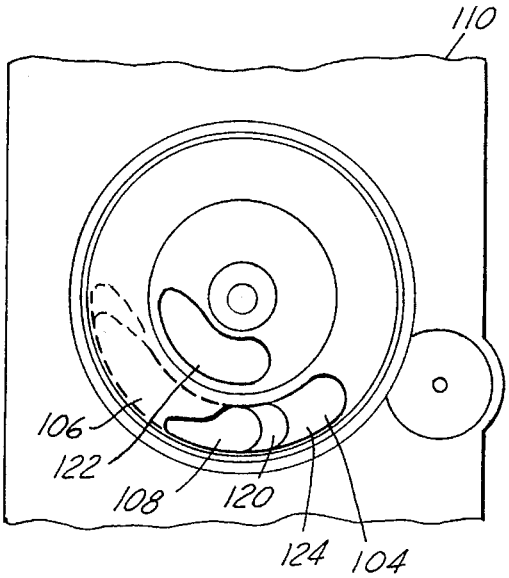
FIG. 10 is a top plan view of the lower head, orbiter and floater of the variable orbital aperture valve system of FIG. 1, wherein the orbiter is shown at a second position and the floater is shown at a second position at the second side of the intake port.
Figure 11:
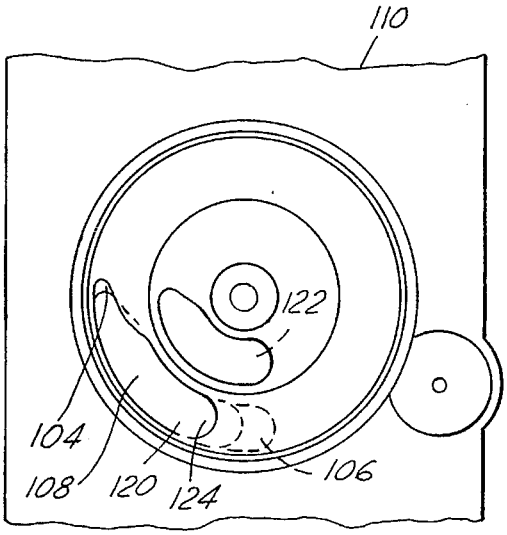
FIG. 11 is a top plan view of the lower head, orbiter and floater of the variable orbital aperture valve system of FIG. 1, wherein the orbiter is shown at the second position and the floater is shown at a third position at the first side of the intake port.

FIGS. 8 through 11 depict views of a lower head 110, an orbiter 104 and a floater 106 (the upper head being removed for clarity) for various positions of the floater; a clockwise rotation (or vice versa) of the orbiter is in response to rotation of the orbiter drive gear 142, and the floater is rotatable clockwise and counter-clockwise in response to actuation of the stepper motor 172 (see FIG. 2A). In FIG. 8, there is no floater and the exhaust and intake ports 108, 112 are simultaneously open; but in FIG. 9, there is a floater 106, so that now with the orbiter 104 in the same position as shown in FIG. 8, only the exhaust port is open. In FIG. 10, the secondary aperture 124 of the floater 106 is located toward the leading side of the intake port 108, whereas in FIG. 11, the secondary aperture is located toward the trailing side of the intake port (where the terms "leading" and "trailling" are determined by the direction of rotation of the orbiter, wherein the side of the port first encountered by a primary (intake or exhaust) aperture of the orbiter is the "leading" side). Note that the position of the orbiter 104 and floater 106 shown in FIG. 11 are the basis for the cross-sectional views of FIGS. 2, 3 and 4.

FIGS. 12 through 16B depict schematically, a variety of possibilities for aspiration of the combustion chamber 114.

Figure 12:
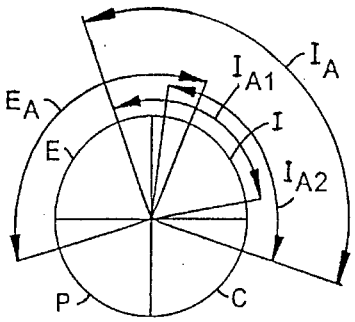
FIG. 12 is an exemplary schematic representation of aspiration events possible during a four stroke cycle of an internal combustion engine equipped with the variable orbital aperture valve system of FIG. 1.

FIG. 12 is an aspiration schematic during the four strokes of a complete cycle: intake, I; compression, C; power, P; and exhaust E of the variable orbital aperture valve system 102. Exhaust aspiration occurs over a range $E_A$. Because of the presence of the floater 106, intake aspiration can occur over range $I_{A1}$ where the secondary aperture is located toward the leading side of the intake port, or over a range $I_{A2}$ where the secondary aperture is located toward the trailing side of the intake port. Intake aspiration range $I_{A1}$ can involve simultaneous intake and exhaust aspiration during the later stage of the exhaust stroke, while intake aspiration range $I_{A2}$ can include intake aspiration during the early stages of the compression stroke.

FIGS. 13A through 16B schematically depict various examples of four strokes of a complete cycle, each cycle having a respective example of a schematic of instantaneous effective exhaust and intake port cross-sections as a function of maximum exhaust and intake port cross-sections during all strokes of a complete cycle versus orbiter rotation over 360 degrees with respect to the exhaust and intake ports, wherein also indicated is top dead center, TCD, and bottom dead center, BDC, for the piston in relation to the cylinder.

Figure 13A:
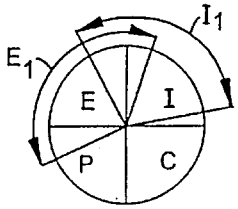
FIG. 13A is a schematic representation of a first aspiration example of the variable orbital aperture valve system of FIG. 1.
Figure 13B:
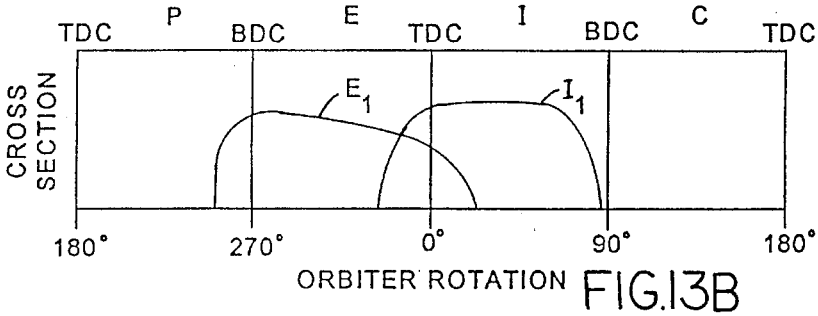
FIG. 13B is an exemplary schematic representation of the effective intake and exhaust port apertures for the first aspiration example of FIG. 13A.

In FIG. 13A, intake aspiration $I_1$ begins before the end of exhaust stroke and continues to just before the end of the intake stroke. To accomplish this, the secondary aperture is positioned appropriately spaced from the trailing side of the intake port. FIG. 13B shows how the effective cross-sections of the exhaust port during the exhaust aspiration event $E_1$ and the intake port during the intake aspiration event $I_1$ could be varied during intake aspiration range of FIG. 13A.

Figure 14A:
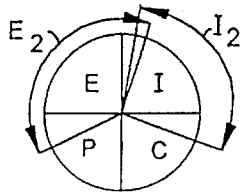
FIG. 14A is a schematic representation of a second aspiration example of the variable orbital aperture valve system of FIG. 1.
Figure 14B:
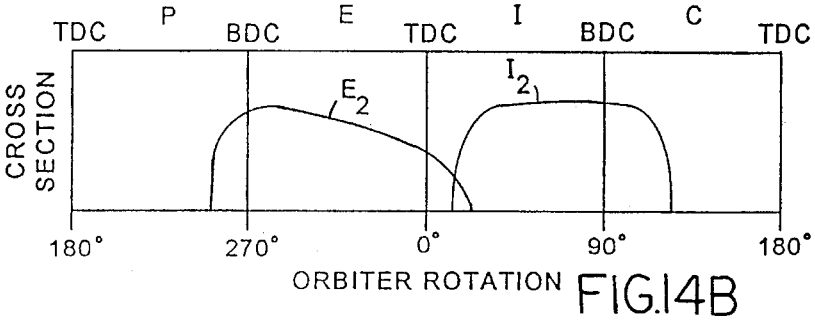
FIG. 14B is an exemplary schematic representation of the effective intake and exhaust port apertures for the second aspiration example of FIG. 14A.

In FIG. 14A, intake aspiration $I_2$ begins after the beginning of the intake stroke and continues to after the end of the intake stroke. To accomplish this, the secondary aperture is positioned appropriately spaced from the leading side of the intake port. FIG. 14B shows how the effective cross-sections of the exhaust port during the exhaust aspiration event $E_2$ and the intake port during the intake aspiration event $I_2$ could be varied during intake aspiration range of FIG. 14A.

Figure 15A:
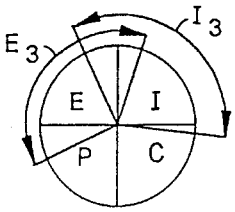
FIG. 15A is a schematic representation of a third aspiration example of the variable orbital aperture valve system of FIG. 1.
Figure 15B:
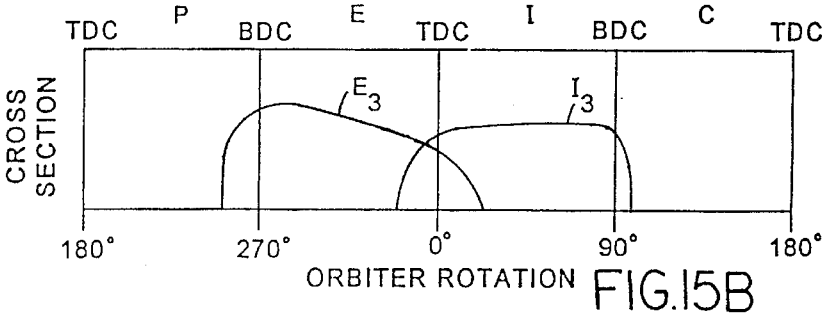
FIG. 15B is an exemplary schematic representation of the effective intake and exhaust port apertures for the third aspiration example of FIG. 15A.

In FIG. 15A, intake aspiration $I_3$ begins before the end of exhaust stroke and continues into the beginning of the compression stroke. To accomplish this, the secondary aperture is positioned appropriately spaced from the trailing side of the intake port. FIG. 15B shows how the effective cross-sections of the exhaust port during the exhaust aspiration event $E_3$ and the intake port during the intake aspiration event 13 could be varied during intake aspiration range of FIG. 15A.

Figure 16A:
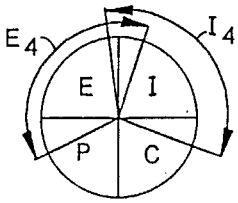
FIG. 16A is a schematic representation of a fourth aspiration example of the variable orbital aperture valve system of FIG. 1.
Figure 16B:
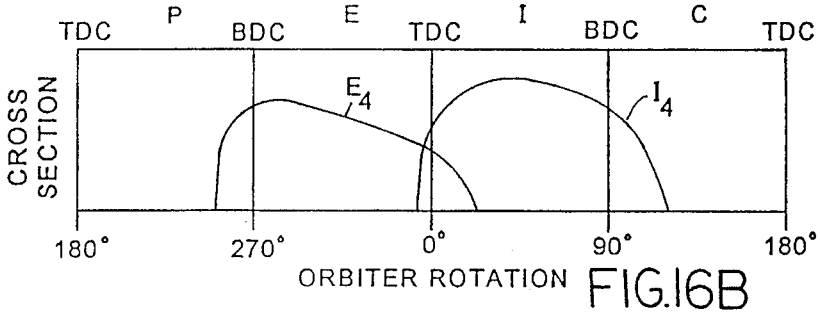
FIG. 16B is an exemplary schematic representation of the effective intake and exhaust port apertures for the fourth aspiration example of FIG. 16A.
Figure 17:
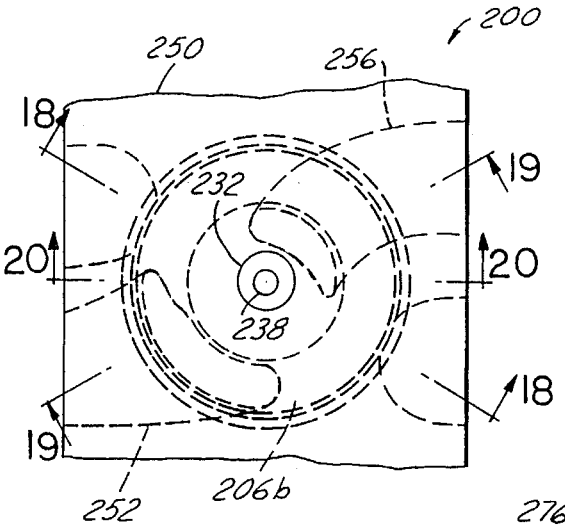
FIG. 17 is a top plan view of a head assembly of an internal combustion engine equipped with the variable orbital aperture valve system according to the present invention, wherein two floaters are provided at the intake port.

In FIG. 16A, intake aspiration $I_4$ begins near the end of exhaust stroke and ends after the end of the intake stroke. To accomplish this, the secondary aperture is positioned appropriately spaced from the leading side of the intake port. FIG. 16B shows how the effective cross-sections of the exhaust port during the exhaust aspiration event $E_4$ and the intake port during the intake aspiration event $I_4$ could be varied during intake aspiration range of FIG. 16A.

Figure 47:
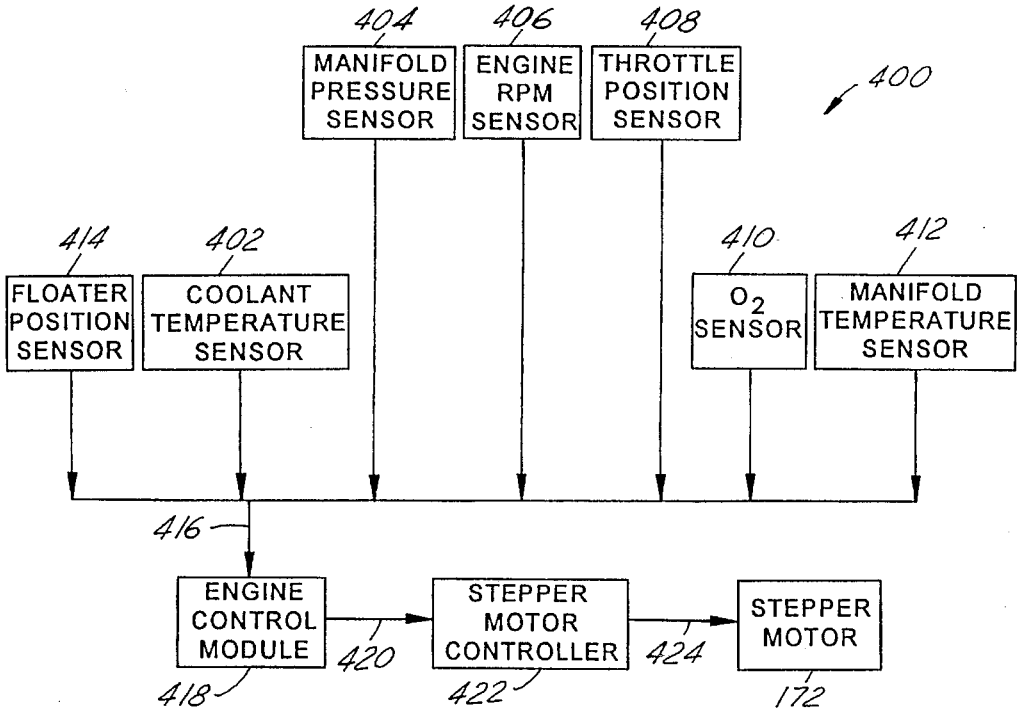
FIG. 47 is a schematic example of a computerized control system ("software cam") for selectively moving one or more floaters in response to sensed engine conditions.
Figure 48:
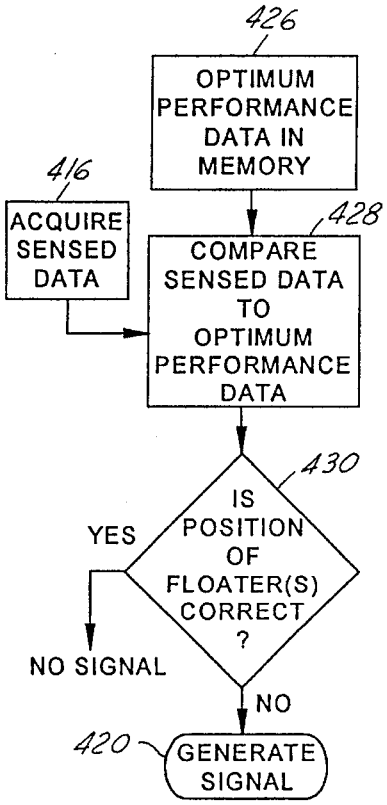
FIG. 48 is a schematic example of a computer program for effecting the computerized control system of FIG. 47.
Figure 49:
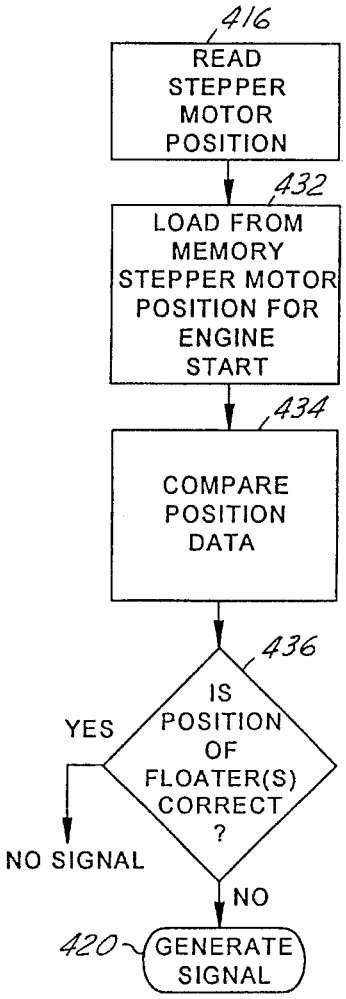
FIG. 49 is a schematic example of an engine start algorithm for the computer program of FIG. 48.
Figure 50:
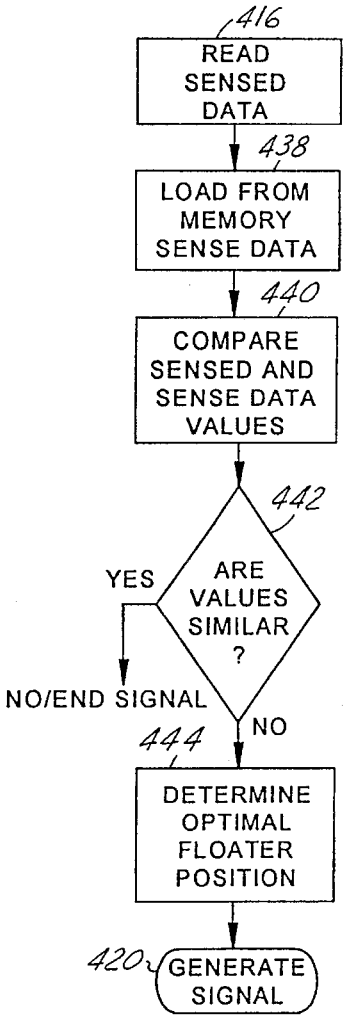
FIG. 50 is a schematic example of an engine running algorithm of the computer program of FIG. 49.

The aforementioned computerized control system ("software cam") 400 is exemplified by FIG. 47 and further programmably exemplified by FIGS. 48 through 50.

As depicted by FIG. 47, a number of engine parameter sensors are provided, such as a coolant temperature sensor 402, a manifold pressure sensor 404, an engine speed sensor 406, a throttle position sensor 408, an oxygen sensor 410, a manifold temperature sensor 412, a floater position sensor 414 which senses the position of the secondary aperture 124 with respect to the intake port 108, and any number of other parameter sensors. The sensed data 416 is fed into the engine control module (ECM) 418, whereat the sensed data is processed together with known data to thereby determine the proper position of the secondary aperture 124 and thereupon generate a signal 420 to actuate the stepper motor 172 (or other actuator). The signal 420 goes to a stepper motor controller 422 which provides timed electrical power 424 to actuate the stepper motor 172 such as to correctly reposition the secondary aperture 124 with respect to the intake port 108.

FIG. 48 depicts an example of a computer program within the ECM 416 for effecting the signal 420. The sensed data 416 and optimum performance data 426 stored in memory are fed into a comparison block 428. If the position of the secondary aperture is proper, no signal is generated; however, if the position of the secondary aperture per the sensed data 416 is improper, the signal 420 is generated to cause the stepper motor controller 422 to appropriately move, clockwise or counter-clockwise, the floater 106 via the stepper motor 172.

FIG. 49 depicts an algorithm for implementing the computer program of FIG. 48 wherein the engine is started. Initially, once the ignition switch is turned on, the program reads the sensed data indicating that an engine start is underway and reads the position of the secondary aperture with respect to the intake port from the floater position sensor 418. The program also loads from memory the proper position of the secondary aperture with respect to the intake port. The combined data is then fed into a comparison block 434. A decision block 436 then ascertains if the secondary aperture 124 is in the correct position relative to the initiate port 108 for the purpose of an engine start. If yes, then no signal is generated; however, if no, then a signal 420 is generated to cause the stepper motor controller 422 to appropriately move, clockwise or counter-clockwise, the floater 106 via the stepper motor 172.

FIG. 50 depicts an algorithm for implementing the computer program of FIG. 48 wherein the engine is running. The program continually reads the sensed data 416 and loads from memory predetermined optimum sense data 438. A comparison block 440 reads the sensed data 416 and the optimum sense data 438 with respect to each sensed parameter. A decision block 442 then determines whether the respective values of the sensed data 416 are the same as the values of the optimum sense data 438, within a predetermined range. If yes, then either no signal is generated or else it is ended; however, if no, then a position determination block 444 determines the optimal position for the floater secondary aperture with respect to the intake port. Thereupon, a signal 420 is generated to cause the stepper motor controller 422 to appropriately move, clockwise or counter-clockwise, the floater 106 via the stepper motor 172. This functionality continuously occurs all during engine operation to thereby continually provide optimal aspiration at all times.

Other computer control systems, computer programs and algorithms may be used to effect actuator control, whether or not the actuator is a stepper motor. For example, the floater can be positioned responsive to predetermined and instantaneous values of stoichiometry using a feedback circuit.

Figure 51:
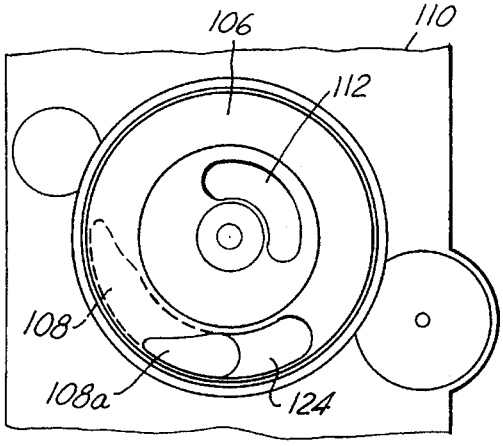
FIG. 51 is a top plan view of the lower head and floater (sans orbiter) of the variable orbital aperture valve system of FIG. 1, wherein the floater is shown at a first position relative to the intake port in response to the computerized control system of FIG. 47 for providing an "idle" mode of operation of the engine thereof.
Figure 52:
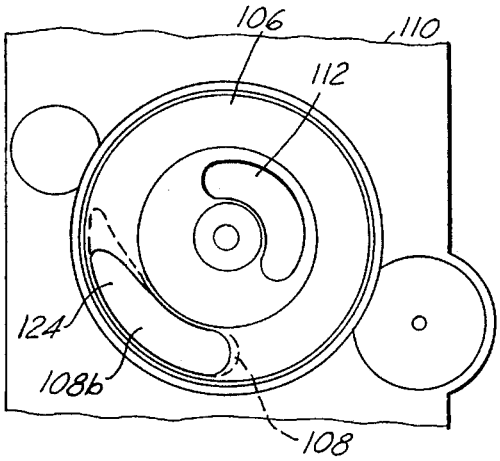
FIG. 52 is a top plan view of the lower head and floater (sans orbiter) of the variable orbital aperture valve system of FIG. 1, wherein the floater is shown at a second position relative to the intake port in response to the computerized control system of FIG. 47 for providing a "cruise" mode of operation of the engine thereof.
Figure 53:
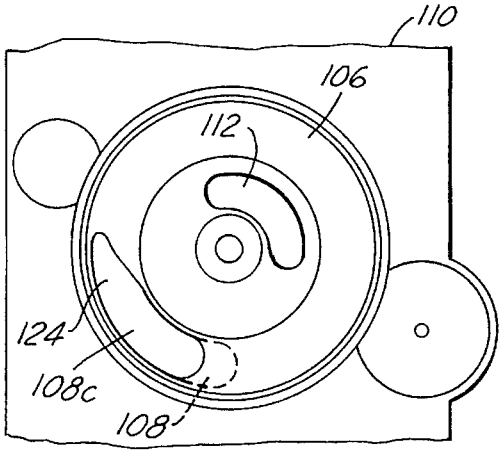
FIG. 53 is a top plan view of the lower head and floater (sans orbiter) of the variable orbital aperture valve system of FIG. 1, wherein the floater is shown at a third position relative to the intake port in response to the computerized control system of FIG. 47 for providing a "passing acceleration" mode of operation of the engine thereof.

FIGS. 51 through 53 depict how the computer control system 400 can dynamically reconfigure aspiration of the combustion chamber 114 of an internal combustion engine operating in an automotive environment. In this regard, the lower head 110 with its intake port 108 and exhaust port 112 is shown with the floater 106 having its secondary aperture 124 in various locations with respect to the intake port (the upper head and the orbiter being absent for the sake of clarity).

FIG. 51 shows the secondary aperture 124 of the floater 106 at a first position relative to the intake port 108 in response to the computerized control system of FIG. 47 for providing an effective intake port area 108*a* for an "idle" mode of operation of the engine thereof.

FIG. 52 shows the secondary aperture 124 of the floater 106 at a second position relative to the intake port 108 in response to the computerized control system of FIG. 47 for providing an effective intake port area 108*b* for a "cruise" mode of operation of the engine thereof.

FIG. 53 shows the secondary aperture 124 of the floater 106 at a third position relative to the intake port 108 in response to the computerized control system of FIG. 47 for providing an effective intake port area 108*c* for a "passing acceleration" mode of operation of the engine thereof.

Example II: Orbiter with Two Floaters at the Intake Port

FIGS. 17 through 20 depict an exemplary head assembly 200 of a reciprocating internal combustion engine which is equipped with a variable orbital aperture valve system 202 according to the present invention.. The head assembly 200 includes a lower head 210, an upper head 250 an orbiter 204 and first and second floaters 206*a*, 206*b* located, respectively at the leading and trailing sides (or vice versa) of the intake port 208 of the lower head. The orbiter 204 rotates with respect to the upper and lower heads and the first and second floaters 206*a*, 206*b* are individually selectively rotatably movable with respect to the upper and lower heads. The lower head 210 has an exhaust port 212 and also has the aforementioned intake port 208 to thereby provide periodic aspiration of a combustion chamber 214, timed according to the reciprocation of the piston 216 in the cylinder 218. The aforesaid aspiration is determined by a primary intake aperture 220 in the orbiter 204 periodically aligning with the intake port 208 and by a primary exhaust aperture 222 in the orbiter periodically aligning with the exhaust port 212. The first and second floaters 206*a*, 206*b* are each respectively provided with a secondary aperture 224*a*, 24*b*, each of which being individually selectively positionable with respect to the intake port 208 by rotative movement thereof with respect thereto. Accordingly, the aforementioned alignment of the primary intake aperture 220 of the orbiter 204 with the intake port 208 is modifiable even while the engine is running by individually selected positioning of the secondary apertures 224*a*, 224*b* of the respective first and second floaters 206*a*, 206*b* with respect to the intake port.

Figure 18:
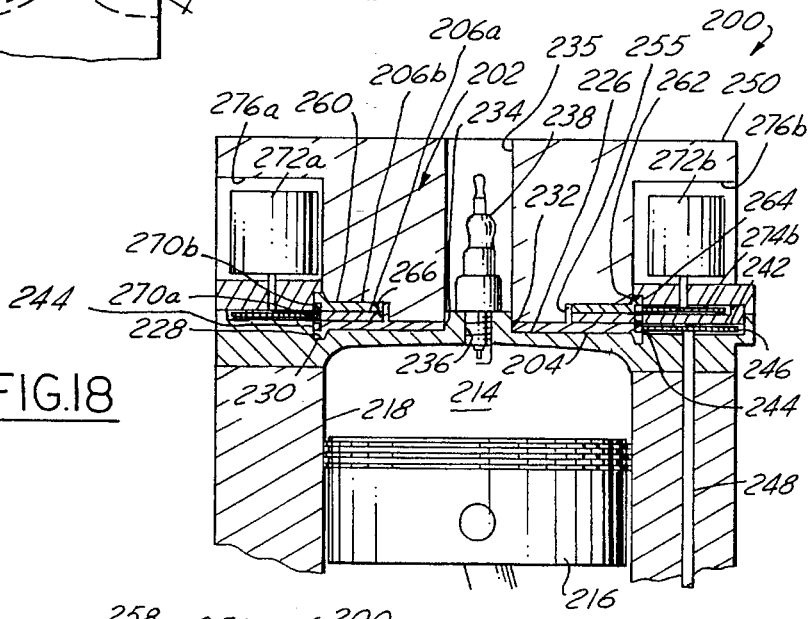
FIG. 18 is a partly broken away, partly sectional side view of the internal combustion engine, seen along line 18—18 in FIG. 17.
Figure 21:
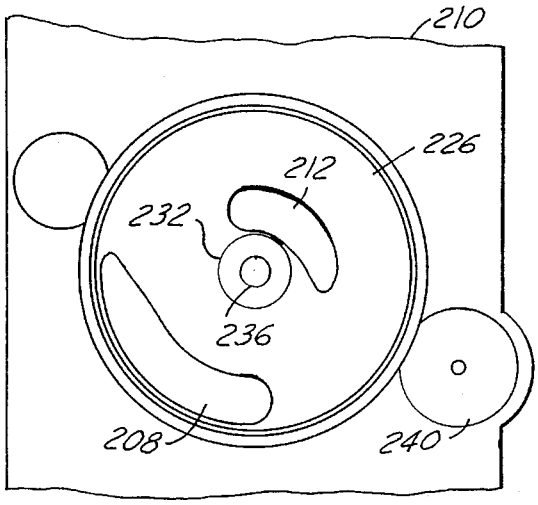
FIG. 21 is a top plan view of the lower head of the internal combustion engine of FIG. 17.

FIG. 21 depicts a plan view of the lower head 210. The depicted intake port 208 and exhaust port 212 are by way of example only and the shape and placement thereof may be varied for engineering reasons. The lower head 210 has an orbiter seat 226 which is recessed an amount that approximates the thickness of the orbiter 204, and an annular groove 228 is provided at the periphery of the orbiter seat 226 for sealingly receiving therein an annular lip 230 of the orbiter 204 which is located at the periphery thereof. An orbiter boss 232 is centrally located in the orbiter seat 226 for sealingly guiding the orbiter 204 at a boss hole 234 is centrally located therein. A threaded spark plug hole 236 is provided in the lower head centrally with respect to the orbiter boss 232 for threadably receiving therein a spark plug 238, as depicted in FIG. 18. Finally, an orbiter drive gear recess 240 is provided in the lower head 210 adjacent the annular groove 228 so that an orbiter drive gear 242 may be located thereat and gearingly mesh with teeth 244 on the periphery of the orbiter 204 (see FIG. 18).

Figure 22:
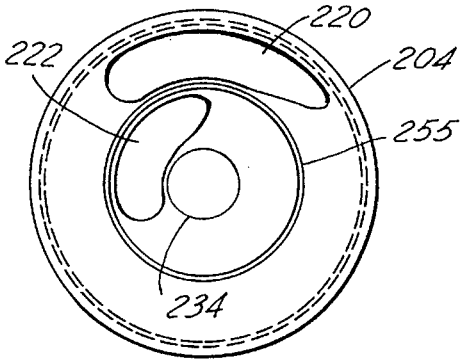
FIG. 22 is a top plan view of the orbiter of the variable orbital aperture valve system of FIG. 17.

As depicted by FIG. 22, the orbiter 204 has the aforementioned primary intake and exhaust apertures 220, 222, which are depicted by way of example only, and the shape and placement thereof may be varied for engineering reasons. As further indicated by reference to FIGS. 18 through 20, the orbiter 204 is configured to sealingly seat abuttably against the orbiter seat 226, wherein the annular lip 230 thereof is sealingly and guidingly received in the annular groove 228, and wherein the teeth 244 thereof are located so that the orbiter drive gear 242 gearingly meshes therewith. Also, as indicated hereinabove, the boss hole 234 of the orbiter 204 is guidingly interfaced with the orbiter boss 232. The placement of the primary intake aperture 220 is such that it will periodically align with the intake port 208 once with each revolution of the orbiter 204. The placement of the primary exhaust aperture 222 is such that it will periodically align with the exhaust port 212 once with each revolution of the orbiter 204. The orbiter 204 further has an annular boss 255 juxtaposed the primary intake and exhaust apertures 220, 222. The annular boss 255 serves to sealingly guide the first and second floaters 206*a*, 206*b* at respective boss holes 268*a*, 268*b* thereof.

The orbiter drive gear 242 is located in the orbiter drive gear recess 240 and has teeth 246 on its periphery which gearingly mesh with the teeth 244 on the periphery of the orbiter. The orbiter drive gear 242 is connected to an orbiter drive gear shaft 248 which gearingly connects with the crank shaft, as for example as described hereinabove, whereby the rotation of the crank shaft, which rotation is directly related to reciprocation of the piston 216, directly determines rotation of the orbiter drive gear shaft, which in the present example is one-half the rotation speed of the crank shaft. Accordingly, for two rotations of the crank shaft, the orbiter 204 makes one revolution, and the intake and exhaust ports 208, 212 are respectively aligned with the primary intake and exhaust apertures 220, 222 one time thereduring.

As will be appreciated from FIGS. 17 through 20, the upper head 250 is removably connected to the lower head 210, such as by bolting, whereby the orbiter 204, first and second floaters 206*a*, 206*b*, and associated components may be installed and serviced. The upper head 250 provides a conduit for an intake manifold 252 and intake manifold port 254 thereof which is positioned directly opposite the intake port 208 and is shaped identically therewith. The upper head 250 further provides a conduit for an exhaust manifold 256 and exhaust manifold port 258 thereof which is positioned directly opposite the exhaust port 212 and is shaped identically therewith. An access cavity 235 is provided therein for the spark plug 238.

Figure 19:
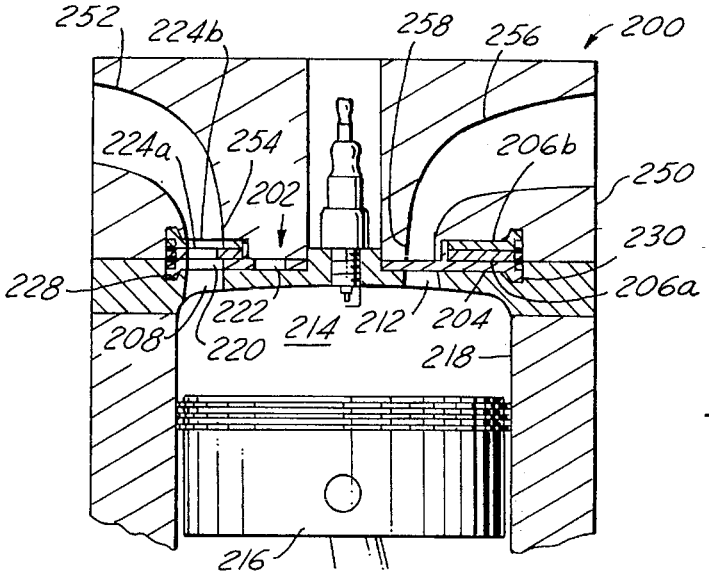
FIG. 19 is a partly broken away, partly sectional side view of the internal combustion engine, seen along line 19—19 in FIG. 17.
Figure 20:
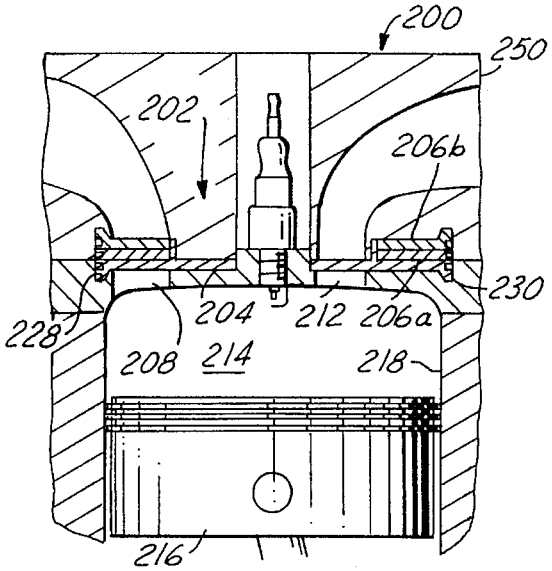
FIG. 20 is a partly broken away, partly sectional side view of the internal combustion engine, seen along line 20—20 in FIG. 17.
Figure 23:
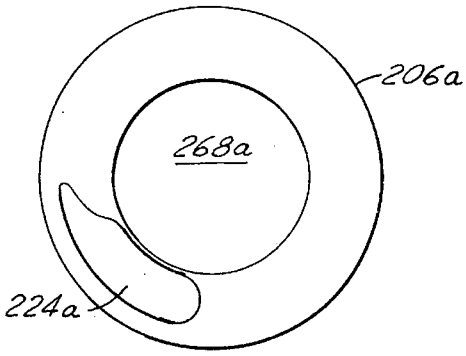
FIG. 23 is a top plan view of a first floater of the variable orbital aperture valve system of FIG. 17.
Figure 24:
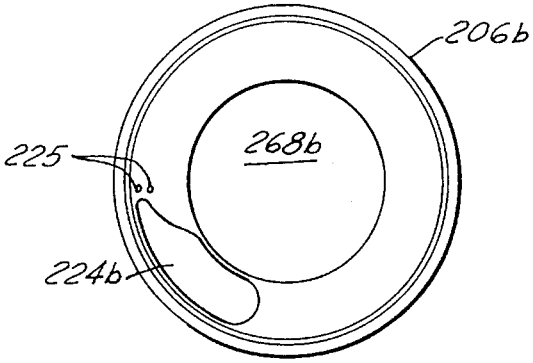
FIG. 24 is a top plan view of a second floater of the variable orbital aperture valve system of FIG. 17.

As shown by FIGS. 23 anti 24, the first and second floaters 206*a*, 206*b* are each respectively provided with the aforesaid secondary aperture 224*a*, 224*b*, which are depicted by way of example only wherein the shape and placement thereof may be varied for engineering reasons. As shown in FIGS. 18 through 20, the upper head 250 is provided with a floater seat 260 which is recessed an amount that approximates the thickness of collectively both the first and second floaters 206*a*, 206*b*. An annular groove 262 is provided at the periphery of the floater seat 260 for sealingly receiving therein an annular lip 264 of the upper positioned second floater 206*b* which is located at the periphery thereof. The lower positioned first floater 206*a* has no lip and is positioned between the orbiter 204 and the second floater 206*b*. The annular boss 255 of the orbiter 204 abuts boss holes 268*a*, 268*b* formed in the first and second floaters 206*a*, 206*b* for sealingly guiding the floaters. Seating, sealing and guiding of the orbiter 204 and the first and second floaters 206*a*, 206*b* are mutually analogous, so that further explanation of the fit of the first and second floaters 206*a*, 206*b* to the upper head 250 is therefore obviated, except to point out that the orbiter mutually sealingly abuts the lower head 210 the first floater 206*a* mutually sealingly abuts the orbiter, and the second floater 206*b* mutually sealingly abuts the first floater 206*a* and the upper head 250. Also, note that an annular upper head boss 266 abuts the annular boss 255 of the orbiter 204.

The first and second floaters 206*a*, 206*b* are each provided with teeth 270*a*, 270*b* at the periphery thereof, respectively. Actuators, preferably in the form of electrically powered stepper motors 272*a*, 272*b*, include a floater drive gear 274*a*, 274*b* which gearingly mesh with the teeth 270*a*, 270*b* of the respective first and second floaters 206*a*, 206*b*. The stepper motors 272*a*, 272*b* (or other actuators) are each respectively located in an actuator recess 276*a*, 276*b* provided in the upper head 250, and is operably controlled by the aforesaid computerized control system 400 schematically shown by way of example in FIG. 47, the nature of which being detailed hereinabove, but now modified for optimally controlling independently and/or collectively the first and second floaters 206*a*, 206*b*.

As indicated hereinabove, the secondary apertures 224*a*, 224*b* are shaped and positioned so as to be alignable over the intake port 208, and selectively render the intake port fully open, partially or fully occluded depending upon individual movement of the first and second floaters 206*a*, 206*b* by respective actuation of the stepper motors 272*a*, 272*b*. Also notable is one or more (two being shown) secondary holes 225 at the second floater 206*b* adjacent the secondary aperture 224*b* thereof for providing potentially supersonic air flow into the intake port 208 when only the holes 225 provide aspiration of the intake port by being aligned thereover.

Figure 25:
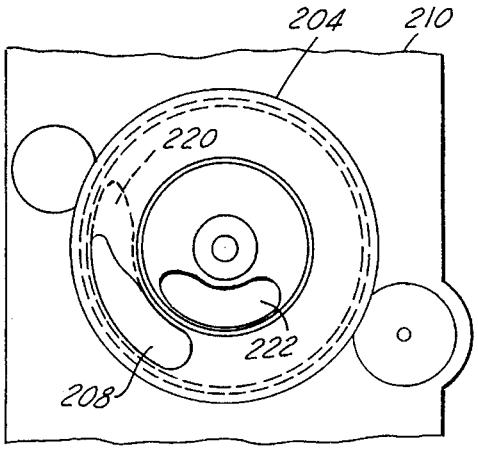
FIG. 25 is a top plan view of the lower head, orbiter and first and second floaters of the variable orbital aperture valve system of FIG. 17, wherein the orbiter is shown at a first position and the first and second floaters are shown at respective first positions at each side of the intake port.
Figure 26:
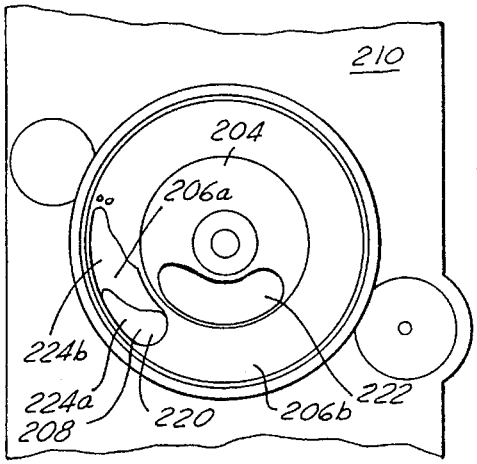
FIG. 26 is a top plan view of the lower head, orbiter and first and second floaters of the variable orbital aperture valve system of FIG. 17, wherein the orbiter is shown at the first position and the first and second floaters are shown at respective second positions at each side of the intake port.

FIGS. 25 and 26 depict views of a lower head 210 with the upper head removed for clarity. A clockwise rotation (or vice versa) of the orbiter is in response to rotation of the orbiter drive gear 242, and the first and second floaters 206*a*, 206*b* are independently rotatable clockwise and counterclockwise in response to actuation of the respective stepper motor 272*a*, 272*b* (see FIG. 18). In FIG. 25, the orbiter 204 is depicted with no floaters at the intake port 208. In FIG. 26, the orbiter 204 is at the same position as in FIG. 25, but now the first and second floaters 206*a*, 206*b* are present, whereby the alignment of the primary intake aperture 220 with the intake port 208 is modified in that a smaller effective intake port area, as well as a changed effective intake port shape, have been provided by appropriate positioning of the secondary apertures 224*a*, 224*b* thereof relative to the intake port 208. Note that the position of the orbiter 204 and the first and second floaters 206*a*, 206*b* shown in FIG. 26 are the basis for the cross-sectional views of FIGS. 18, 19 and 20.

FIGS. 27 through 31B depict schematically, a variety of possibilities for aspiration of the combustion chamber 214.

Figure 27:
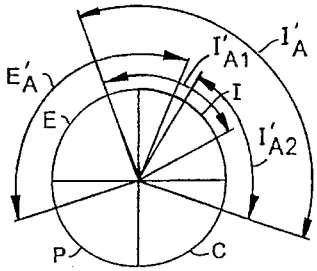
FIG. 27 is an exemplary schematic representation of aspiration events possible during a four stroke cycle of an internal combustion engine equipped with the variable orbital aperture valve system of FIG. 17.

FIG. 27 is an aspiration schematic during the four strokes of a complete cycle: intake, I; compression, C; power, P; and exhaust E for the variable orbital aperture valve system 202. Exhaust aspiration occurs over a range $E_A'$. Because of the presence of the first and second floaters 206*a*, 206*b*, intake aspiration can occur over range $I_{A1}'$ where the secondary aperture of the first floater 206*a* is located toward the leading side of the intake port, and over a range $I_{A2}'$ where the secondary aperture of the second floater 206*b* is located toward the trailing side of the intake port. Intake aspiration range $I_{A1}'$ can involve simultaneous intake and exhaust aspiration during the later stage of the exhaust stroke, while intake aspiration range $I_{A2}'$ can include intake aspiration during the early stage of the compression stroke.

FIGS. 28A through 31B schematically depict various examples of four strokes of a complete cycle, each cycle having a respective example of a schematic of instantaneous effective exhaust and intake port cross-sections as a function of maximum exhaust and intake port cross-sections during all strokes of a complete cycle versus orbiter rotation over 360 degrees with respect to the exhaust and intake ports, wherein also indicated is top dead center, TDC, and bottom dead center, BDC, for the piston in relation to the cylinder.

Figure 28A:
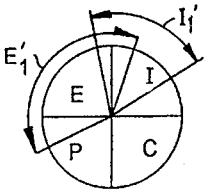
FIG. 28A is a schematic representation of a first aspiration example of the variable orbital aperture valve system of FIG. 17.
Figure 28B:
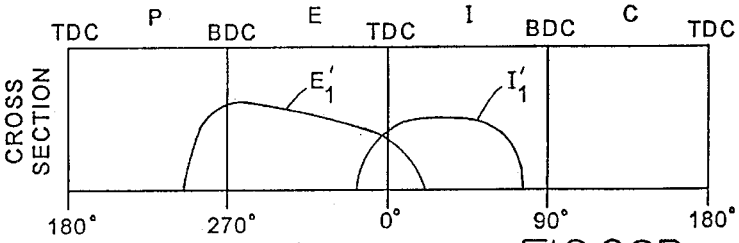
FIG. 28B is an exemplary schematic representation of the effective intake and exhaust port apertures for the first aspiration example of FIG. 28A.

In FIG. 28A, intake aspiration begins just before the end of the exhaust stroke and terminates before the end of the intake stroke. To accomplish this, the secondary apertures are positioned appropriately with respect to the leading and trailing sides of the intake port. FIG. 28B shows how the effective cross-sections of the exhaust port during the exhaust aspiration event $E_1'$ and the intake port during the intake aspiration event $I_1'$ could be varied during intake aspiration range of FIG. 28A.

Figure 29A:
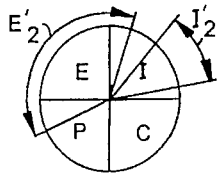
FIG. 29A is a schematic representation of a second aspiration example of the variable orbital aperture valve system of FIG. 17.
Figure 29B:
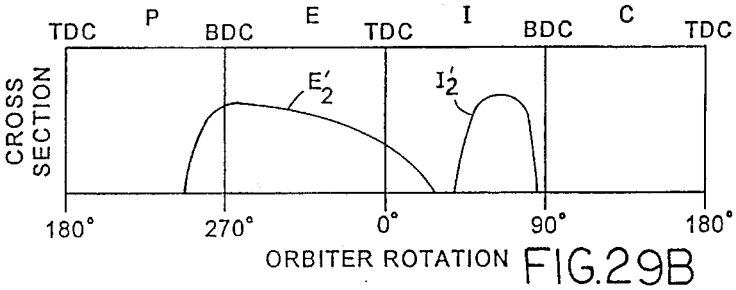
FIG. 29B is an exemplary schematic representation of the effective intake and exhaust port apertures for the second aspiration example of FIG. 29A.

In FIG. 29A, intake aspiration begins long after the beginning of the intake stroke and ends before the beginning of the compression stroke. To accomplish this, the secondary apertures are positioned appropriately with respect to the leading and trailing sides of the intake port. FIG. 29B shows how the effective cross-sections of the exhaust port during the exhaust aspiration event $E_2'$ and the intake port during the intake aspiration event $I_2'$ could be varied during intake aspiration range of FIG. 29A.

Figure 30A:
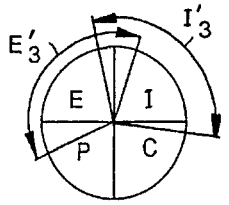
FIG. 30A is a schematic representation of a third aspiration example of the variable orbital aperture valve system of FIG. 17.
Figure 30B:
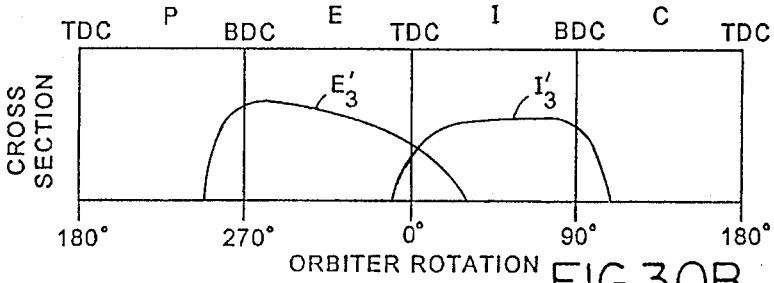
FIG. 30B is an exemplary schematic representation of the effective intake and exhaust port apertures for the third aspiration example of FIG. 30A.
Figure 31A:
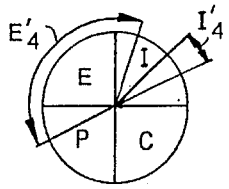
FIG. 31A is a schematic representation of a fourth aspiration example of the variable orbital aperture valve system of FIG. 17.
Figure 31B:
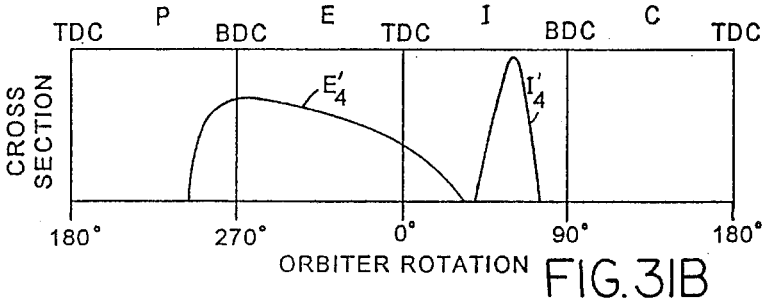
FIG. 31B is an exemplary schematic representation of the effective intake and exhaust port apertures for the fourth aspiration example of FIG. 31A.

In FIG. 30A, intake aspiration begins near the end of the exhaust stroke and continues into the beginning of the ,compression stroke. To accomplish this, the secondary apertures are positioned appropriately with respect to the leading and trailing sides of the intake port. FIG. 30B shows how the effective cross-sections of the exhaust port during the exhaust aspiration event $E_3'$ and the intake port during the intake aspiration event $I_3'$ could be varied during intake aspiration range of FIG. 30A.

Figure 32:
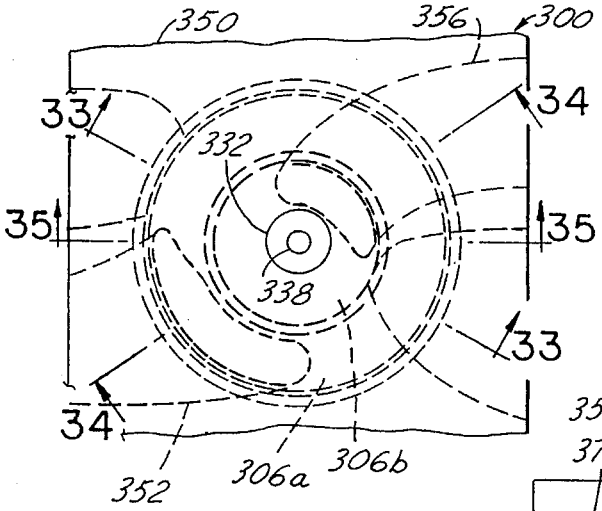
FIG. 32 is a top plan view of a head assembly of an internal combustion engine equipped with the variable orbital aperture valve system according to the present invention, wherein an intake floater is provided at the intake port and an exhaust floater is provided at the exhaust port.

In FIG. 32A, intake aspiration begins long after the beginning of the intake stroke and ends well before the end of the intake stroke. To accomplish this, the secondary apertures are positioned appropriately with respect to the leading and trailing sides of the intake port. FIG. 32B shows how the effective cross-sections of the exhaust port during the exhaust aspiration event $E_4'$ and the intake port during the intake aspiration event $I_4'$ could be varied during intake aspiration range of FIG. 32A.

The aforementioned computerized control system 400 of FIG. 47 is modified whereby the floater position sensor 414 now senses the position of each of the first and second floaters 206*a*, 206*b*, and the program of FIG. 48 is now modified to process data to provide optimal engine performance based upon two floaters at the intake port, which can now include independently positioning the first and second floaters to thereby modify the beginning and/or end of the intake valve event, the duration of the intake valve event and the centerline thereof, as well as the effective intake port area and shape.

Figure 54:
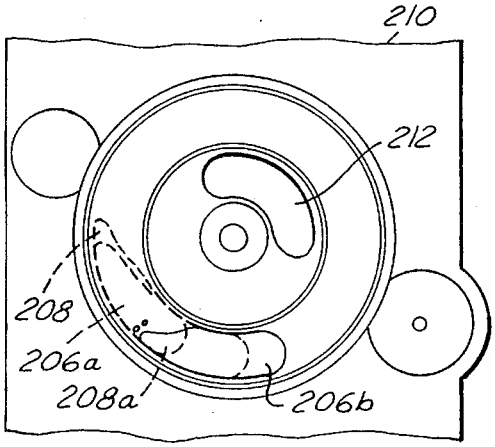
FIG. 54 is a top plan view of the lower head and first and second floaters (sans orbiter) of the variable orbital aperture valve system of FIG. 17, wherein the first and second floaters are shown at positions relative to the intake port in response to the computerized control system of FIG. 47 for providing a "cruise" mode of operation of the engine thereof.

FIG. 54 depicts an example of how the computer control system 400 has dynamically reconfigured aspiration of the combustion chamber 114 of an internal combustion engine operating in an automotive environment. In this regard, the lower head 210 and first and second floaters 206*a*, 206*b* are shown in typical instantaneous positions (the upper head and the orbiter being removed for clarity), to provide for "cruise" operation, wherein the computerized control system 400 has located the secondary apertures 224*a*, 224*b* of the first and second floaters 206*a*, 206*b* with respect to the intake port 208 so that the overlapping of the secondary apertures provide a relatively small, middle positioned effective opening of the intake port by moving the floaters via the stepper motors 272*a*, 272*b*.

Example III: Orbiter with One Floater at the Intake Port and One Floater at the Exhaust Port FIGS. 32 through 35 depict an exemplary head assembly 300 of a reciprocating internal combustion engine which is equipped with a variable orbital aperture valve system 302 according to the present invention. The head assembly 300 includes a lower head 310, an upper head 350, an orbiter 304, an intake floater 306*a* located at either of the leading and trailing sides of the intake port 308 of the lower head, and an exhaust floater 306*b* located at either of the leading and trailing sides of the exhaust port 312 of the lower head. The orbiter 304 rotates with respect to the upper and lower heads and the intake and exhaust floaters 306*a*, 306*b* arc individually selectively rotatably movable with respect to the upper and lower heads. The lower head 310 has the aforementioned intake port 308 and exhaust port 312 to thereby provide periodic aspiration of a combustion chamber 314, timed according to the reciprocation of the piston 316 in the cylinder 318. The aforesaid aspiration is determined by a primary intake aperture 320 in the orbiter 304 periodically aligning with the intake port 308 and by a primary exhaust aperture 322 in the orbiter periodically aligning with the exhaust port 312. The intake and exhaust floaters 306*a*, 306*b* are each respectively provided with a secondary aperture 324*a*, 324*b*, each of which being individually selectively positionable with respect to the respective intake and exhaust ports 308, 312 by rotative movement thereof with respect thereto. Accordingly, the aforementioned alignment of the primary intake aperture 320 of the orbiter 304 with the intake port 308 and the aforementioned alignment of the primary exhaust aperture 322 with the exhaust port 312 are each separately modifiable even while the engine is running by individually selected positioning of the secondary apertures 324*a*, 324*b* of the respective intake And exhaust floaters 306*a*, 306*b* with respect to the respective intake and exhaust ports.

Figure 33:
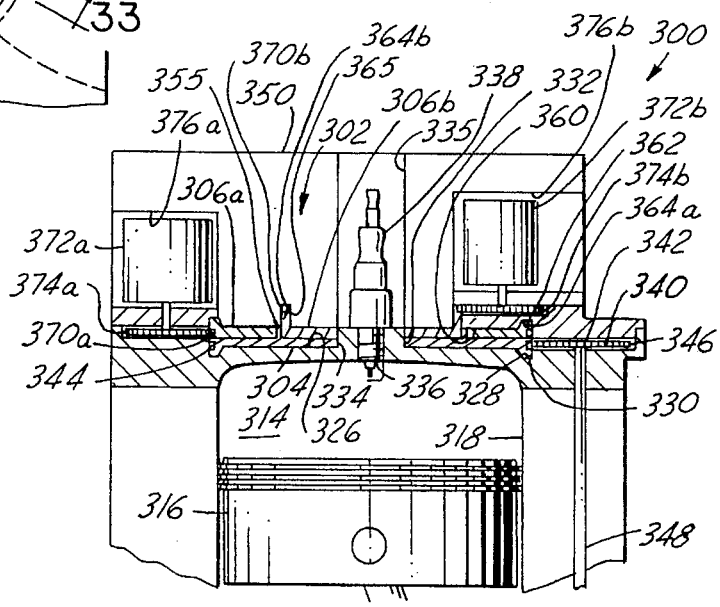
FIG. 33 is a partly broken away, partly sectional side view of the internal combustion engine, seen along line 33—33 in FIG. 32.
Figure 36:
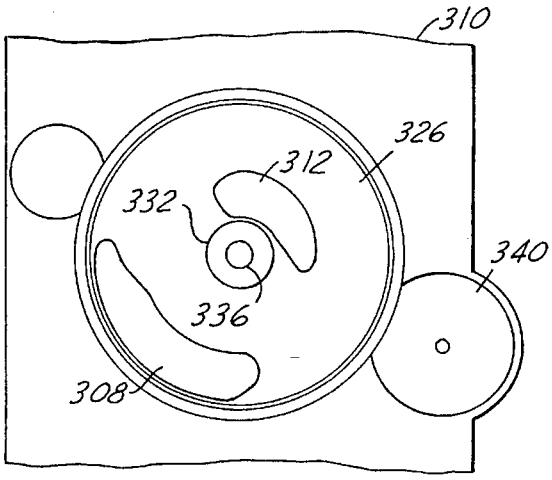
FIG. 36 is a top plan view of the lower head of the internal combustion engine of FIG. 32.

FIG. 36 depicts a plan view of the lower head 310. The depicted intake port 308 and exhaust port 312 are by way of example only and the shape and placement thereof may be varied for engineering reasons. The lower head 310 has an orbiter seat 326 which is recessed an amount, that approximates the thickness of the orbiter 304, and an annular groove 328 is provided at the periphery of the orbiter seat 326 for sealingly receiving therein an annular lip 330 of the orbiter 304 which is located at the periphery thereof. An orbiter boss 332 is centrally located in the orbiter seat 326 for sealingly guiding the orbiter 304 at a boss hole 334 centrally located therein. A threaded spark plug hole 336 is provided in the lower head centrally with respect to the orbiter boss 332 for threadably receiving therein a spark plug 338, as depicted in FIG. 33. Finally, an orbiter drive gear recess 340 is provided in the head 310 adjacent the annular groove 328 so that an orbiter drive gear 342 may be located thereat and gearingly mesh with teeth 344 on the periphery of the orbiter 304 (see FIG. 33).

Figure 37:
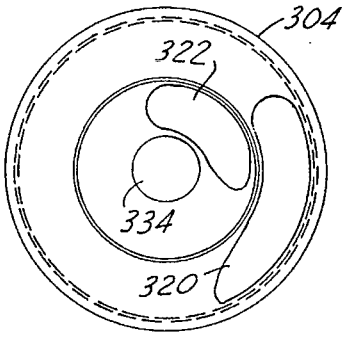
FIG. 37 is a top plan view of the orbiter of the variable orbital aperture valve system of FIG. 32.

As depicted by FIG. 37, the orbiter 304 has the aforementioned primary intake and exhaust apertures 320, 322, which are depicted by way of example only, and the shape and placement thereof may be varied for engineering reasons. As further indicated by reference to FIGS. 33 through 35, the orbiter 304 is configured to sealingly seat abuttably against the orbiter seat 326, wherein the annular lip 330 thereof is sealingly and guidingly received in the annular groove 328, and wherein the teeth 344 thereof are located so that the orbiter drive gear 342 gearingly meshes therewith. Also, as indicated hereinabove, the boss hole 334 of the orbiter 304 is guidingly interfaced with the orbiter boss 332. The placement of the primary intake aperture 320 is such that it will periodically align with the intake port 308 once with each revolution of the orbiter 304. The placement of the primary exhaust aperture 322 is such that it will periodically align with the exhaust port 312 once with each revolution of the orbiter 304. The orbiter 304 further has an annular boss 355 juxtaposed the primary intake and exhaust apertures 320, 322. The annular boss 355 serves to sealingly guide the intake and exhaust floaters 306*a*, 306*b* at either side thereof.

The orbiter drive gear 342 is located in the orbiter drive gear recess 340 and has teeth 346 on its periphery which gearingly mesh with the teeth 344 on the periphery of the orbiter. The orbiter drive gear 342 is connected to an orbiter drive gear shaft 348 which gearingly connects with the crank shaft, as for example as described hereinabove, whereby the rotation of the crank shaft, which rotation is directly related to reciprocation of the piston 316, directly determines rotation of the orbiter drive gear shaft, which in the present example is one-half the rotation speed of the crank shaft. Accordingly, for two rotations of the crank shaft, the orbiter 304 makes one revolution, and the intake and exhaust ports 308, 312 are respectively aligned with the primary intake and exhaust apertures 320, 322 one time thereduring.

As will be appreciated from FIGS. 32 through 35, the upper head 350 is removably connected to the lower head 310, such as by bolting, whereby the orbiter 304, the first and second floaters 306*a*, 306*b*, and associated components may be installed and serviced. The upper head 350 provides a conduit for an intake manifold 352 and intake manifold port 354 thereof which is positioned directly opposite the intake port 308 and is shaped identically therewith. The upper head 350 further provides a conduit for an exhaust manifold 356 and exhaust manifold port 358 thereof which is positioned directly opposite the exhaust port 312 and is shaped identically therewith. An access cavity 335 is provided therein for the spark plug 338.

Figure 34:
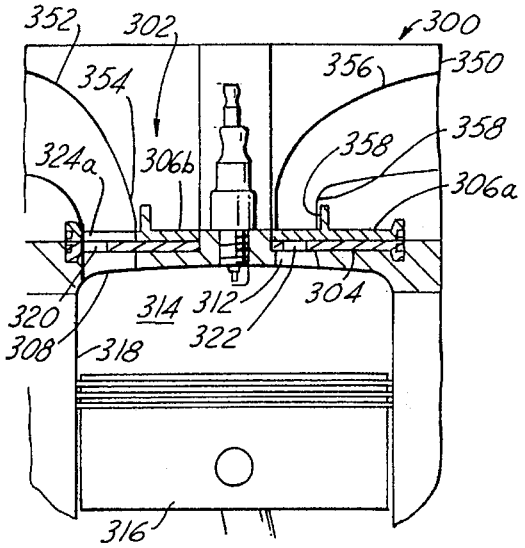
FIG. 34 is a partly broken away, partly sectional side view of the internal combustion engine, seen along line 34—34 in FIG. 32.
Figure 35:
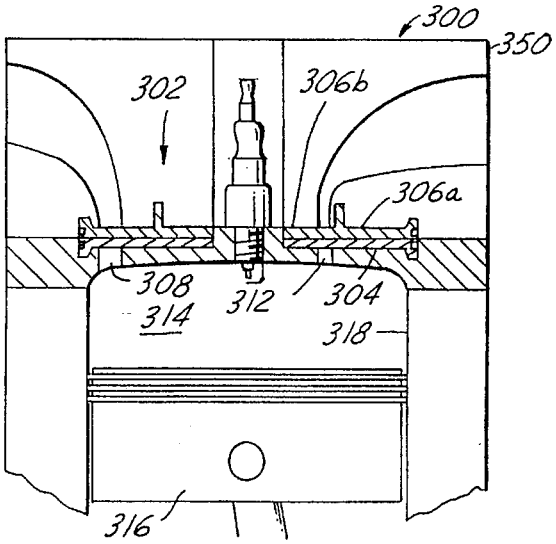
FIG. 35 is a partly broken away, partly sectional side view of the internal combustion engine, seen along line 35—35 in FIG. 32.
Figure 39:
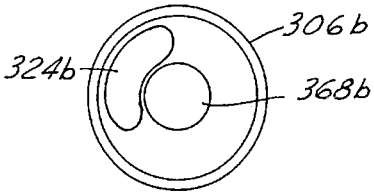
FIG. 39 is a top plan view of the exhaust floater of the variable orbital aperture valve system of FIG. 32.
Figure 38:
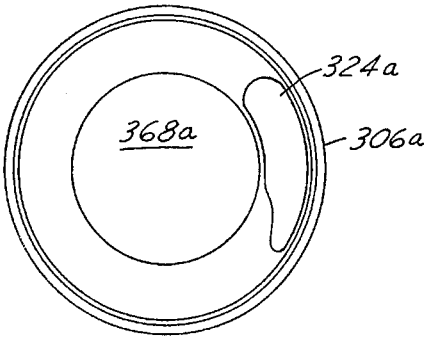
FIG. 38 is a top plan view of the intake floater of the variable orbital aperture valve system of FIG. 32.

As shown by FIGS. 38 and 39, the intake and exhaust floaters 306*a*, 306*b* are each respectively provided with the aforesaid secondary aperture 324*a*, 324*b*, which are depicted by way of example only wherein the shape and placement thereof may be varied for engineering reasons. As shown in FIGS. 33 through 35, the upper head 350 is provided with a floater seat 360 which is recessed an amount that approximates the thickness of each of the intake and exhaust floaters 306*a*, 306*b*. An annular groove 362 is provided at the periphery of the floater seat 360 for sealingly receiving therein an annular lip 364*a* of the intake floater 306*a* which is located at the periphery thereof. The exhaust floater 306*b* has an annular lip 364*b* of increased height (in comparison with the annular lip 364*a* of the intake floater) located in an annular slot 365 formed in the upper head 350 as shown in FIG. 33, and is positioned at the periphery thereof adjacent the annular boss 355. The annular boss 355 of the orbiter 304 abuts the periphery of the exhaust floater 306*b* on one side and, on the other side, a boss hole 368*a* formed in the intake floater 306*a* for sealingly guiding the intake and exhaust floaters. Further, the exhaust floater 306*b* has a boss hole 368*b* which abuts the orbiter boss 332. Seating, sealing and guiding of the orbiter 304 and the intake and exhaust floaters 306*a*, 306*b* are mutually analogous, so that further explanation of the fit of the intake and exhaust floaters 306*a*, 306*b* to the upper head 350 is therefore obviated, except to point out that the intake and exhaust floaters mutually sealingly abut the orbiter, the intake and exhaust floaters mutually sealingly abut the tipper head 350, and the orbiter mutually sealingly abuts the lower head 310.

The intake and exhaust floaters 306*a*, 306*b* are respectively provided with teeth 370*a*, 370*b* at the periphery thereof. Actuators, preferably in the form of electrically powered stepper motors 372*a*, 372*b*, include a floater drive gear 374*a*, 374*b* which gearingly mesh with the teeth 370*a*, 370*b* of the respective intake and exhaust floaters 306*a*, 306*b*. The stepper motors 372*a*, 372*b* (or other actuators) are each respectively located in an actuator recess 376*a*, 376*b* provided in the upper head 350, and is operably controlled by the aforesaid computerized control system 400 schematically shown by way of example in FIG. 47, the nature of which being detailed hereinabove, but now modified for optimally controlling two floaters, one on each of the intake and exhaust ports 306*a*, 306*b*.

As indicated hereinabove, the secondary apertures 324*a*, 324*b* are shaped and positioned so as to be alignable over the respective intake and exhaust ports 308, 312 and independently selectively render the respective intake and exhaust ports open or partially occluded depending upon individual movement of the intake and exhaust floaters 306*a*, 306*b* by respective actuation of the stepper motors 372*a*, 372*b*.

Figure 40:
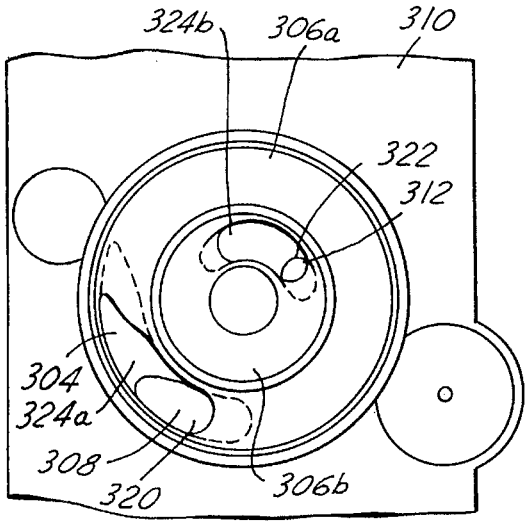
FIG. 40 is a top plan view of the lower head, orbiter and intake and exhaust floaters of the variable orbital aperture valve system of FIG. 32, wherein the orbiter is shown at a first position, the intake floater is shown at a first position at a side of the intake port, and the exhaust floater is shown at a first position at a side of the exhaust port.
Figure 41:
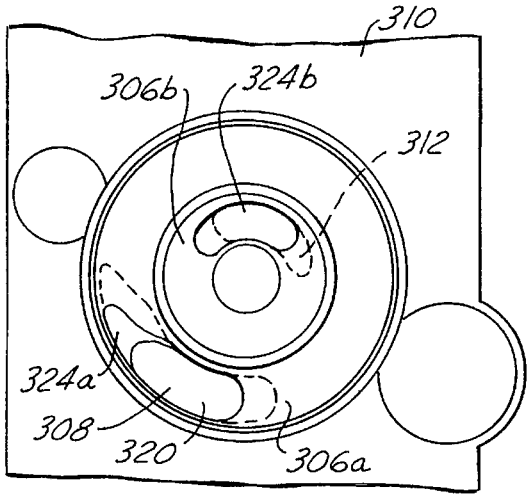
FIG. 41 is a top plan view of the lower head, orbiter and first and second floaters of the variable orbital aperture valve system of FIG. 32, wherein the orbiter is shown at the first position, the intake floater is shown at a second position at the side of the intake port, and the exhaust floater is shown at a second position at the side of the exhaust port.

FIGS. 40 and 41 depict views of a lower 310 with the upper head removed for clarity. A clockwise rotation (or vice versa) of the orbiter is in response to rotation of the orbiter drive gear 342, and the intake and exhaust floaters 306*a*, 306*b* are independently rotatable clockwise and counter-clockwise in response to actuation of the respective stepper motor 372*a*, 372*b* (see FIG. 33). In FIG. 40, the orbiter 304 is depicted in a selected position with respect to the lower head, and the intake and exhaust floaters 306*a*, 306*b* each at selected positions relative to the respective intake and exhaust ports 308, 312. In FIG. 41, the orbiter 304 is at the same position as in FIG. 40, but now the intake floater 306*a* has been rotated clockwise, and the exhaust floater has been rotated counter-clockwise. Note that the position of the orbiter 304 and the intake and exhaust floaters 306*a*, 306*b* showing in FIG. 41 are the basis for the cross-sectional views of FIGS. 33, 34, and 35.

FIGS. 42 through 46B depict schematically, a variety of possibilities for aspiration of the intake combustion chamber 314.

Figure 42:
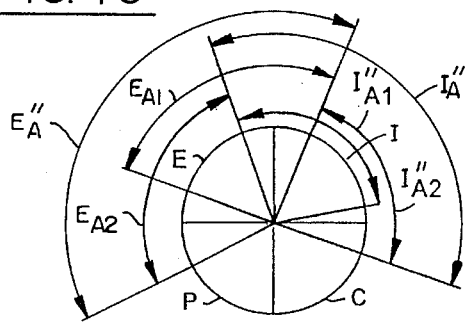
FIG. 42 is an exemplary schematic representation of aspiration events possible during a four stroke cycle of an internal combustion engine equipped with the variable orbital aperture valve system of FIG. 32.

FIG. 42 is an aspiration schematic during the four strokes of a complete cycle: intake, I; compression, C; power, P; and exhaust E for the variable orbital aperture valve system 302. Because of the presence of the intake and exhaust floaters 306*a*, 306*b*, intake aspiration can occur over range $I_{A1}$" where the secondary aperture of the intake floater 306*a* is located toward the leading side of the intake port or over a range $I_{A2}$" where the secondary aperture of intake floater 306*a* is located toward the trailing side of the intake port, and exhaust aspiration can occur over range $E_{A1}$" where the secondary aperture of the exhaust floater 306*b* is located toward the leading side of the exhaust port or over a range $E_{A2}$" where the secondary aperture of the exhaust floater 306*b* is located toward the trailing side of the exhaust port. Possible aspiration variations include simultaneous intake and exhaust aspiration, possible intake aspiration during the beginning of the compression stroke and possible exhaust aspiration before the end of the power stroke.

FIGS. 43A through 46B schematically depict various examples of four strokes of a complete cycle, each cycle having a respective example of a schematic of instantaneous effective exhaust and intake port cross-sections as a function of maximum exhaust and intake port cross-sections during all strokes of a complete cycle versus orbiter rotation over 360 degrees with respect to the exhaust and intake ports, wherein also indicated is top dead center, TDC, and bottom dead center, BDC, for the piston in relation to the cylinder.

Figure 43A:
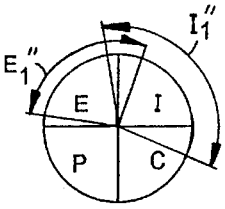
FIG. 43A is a schematic representation of a first aspiration example of the variable orbital aperture valve system of FIG. 32.
Figure 43B:
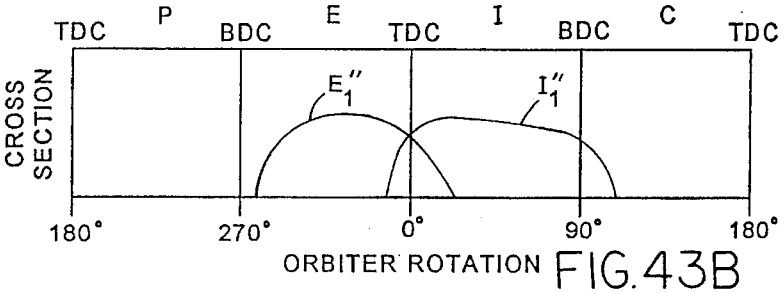
FIG. 43B is an exemplary schematic representation of the effective intake and exhaust port apertures for the first aspiration example of FIG. 43A.

In FIG. 43A, exhaust aspiration begins after the beginning of the exhaust stroke and continues into the beginning of the intake stroke; intake aspiration begins just before the end of the exhaust stroke and terminates after the end of the intake stroke. To accomplish this, the secondary apertures are positioned appropriately with respect to the leading side of the intake port and the leading side of the exhaust port. FIG. 43B shows how the effective cross-sections of the exhaust port during an exhaust aspiration event $E_1''$ and the intake port during the, intake aspiration event $I_1''$ could be varied during intake and exhaust aspiration ranges of FIG. 43A.

Figure 44A:
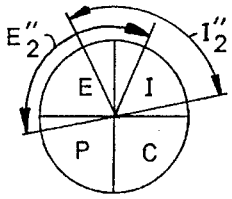
FIG. 44A is a schematic representation of a second aspiration example of the variable orbital aperture valve system of FIG. 32.
Figure 44B:
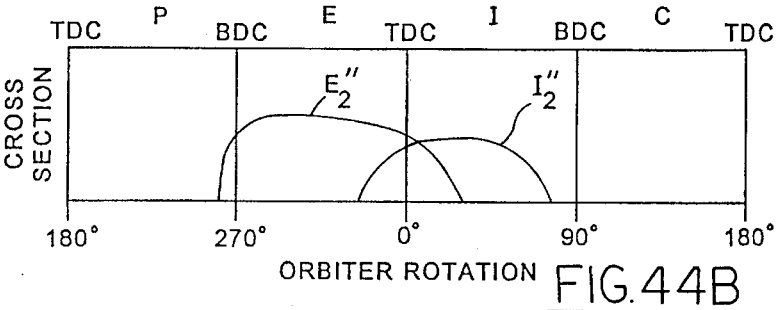
FIG. 44B is an exemplary schematic representation of the effective intake and exhaust port apertures for the second aspiration example of FIG. 44A.

In FIG. 44A, exhaust aspiration begins before the end of the power stroke and concludes after the end of the exhaust stroke; intake aspiration begins before the beginning of the intake stroke and terminates before the end of the intake stroke. To accomplish this, the secondary apertures are positioned appropriately with respect to the trailing side of the intake port and the leading side of the exhaust port. FIG. 44B shows how the effective cross-sections of the exhaust port during the exhaust aspiration event $E_2''$ and the intake port during the intake aspiration event $I_2''$ could be varied during intake and exhaust aspiration ranges of FIG. 44A.

Figure 45A:
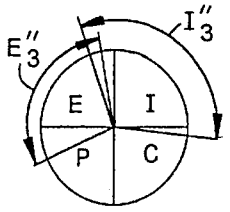
FIG. 45A is a schematic representation of a third aspiration example of the variable orbital aperture valve system of FIG. 32.
Figure 45B:
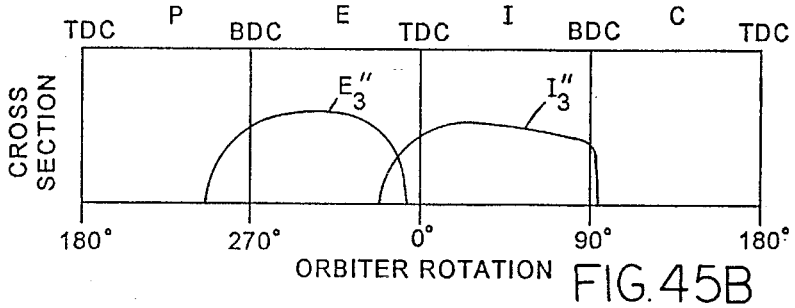
FIG. 45B is an exemplary schematic representation of the effective intake and exhaust port apertures for the third aspiration example of FIG. 45A.

In FIG. 45A, exhaust aspiration begins before the beginning of the exhaust stroke and continues into the beginning of the intake stroke; intake aspiration begins after the beginning of the intake stroke and terminates after the beginning of the compression stroke. To accomplish this, the secondary apertures are positioned appropriately with respect to the leading side of the intake port and the trailing side of the exhaust port. FIG. 45B shows how the effective cross-sections of the exhaust port during the exhaust aspiration event $E_3''$ and the intake port during the intake aspiration event $I_3''$ could be varied during intake and exhaust aspiration ranges of FIG. 45A.

Figure 46A:
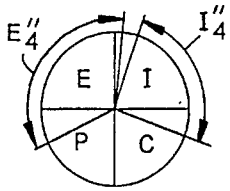
FIG. 46A is a schematic representation of a fourth aspiration example of the variable orbital aperture valve system of FIG. 32.
Figure 46B:
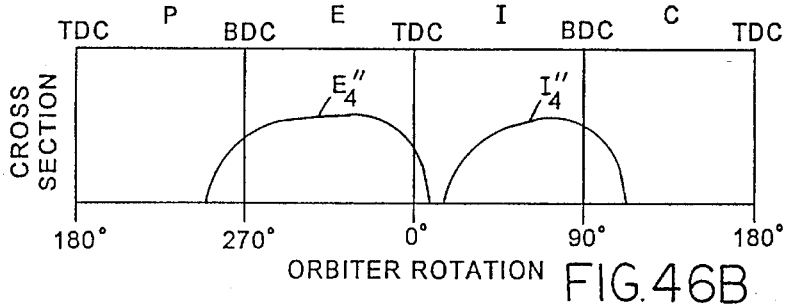
FIG. 46B is an exemplary schematic representation of the effective intake and exhaust port apertures for the fourth aspiration example of FIG. 46A.

In FIG. 46A, exhaust aspiration begins before the end of the power stroke and terminates after the end of the exhaust stroke; intake aspiration begins after the beginning of the intake stroke and terminates after the end of the intake stroke. To accomplish this, the secondary apertures are positioned appropriately with respect to the leading side of the intake port and the trailing side of the exhaust port. FIG. 46B shows how the effective cross-sections of the exhaust port during the exhaust aspiration event $E_4''$ and the intake port during the intake aspiration event $I_4''$ could be varied during intake and exhaust aspiration ranges of FIG. 46A.

The aforementioned computerized control system 400 of FIG. 47 is modified whereby the floater position sensor 414 now senses the position of each of the intake and exhaust floaters 306*a*, 306*b*, and the program of FIG. 48 is now modified to process data to provide optimal engine performance based upon the intake and exhaust floaters, which can now include independently and/or collectively positioning the floaters to thereby modify either or both alignments of the primary intake and exhaust apertures respectively with the intake and exhaust ports.

Figure 55:
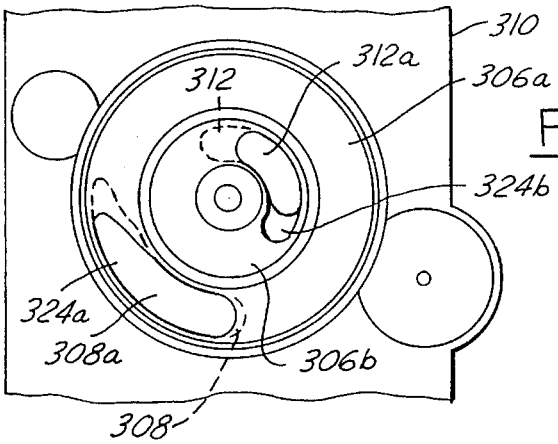
FIG. 55 is a top plan view of the lower head and intake and exhaust floaters (sans orbiter) of the variable orbital aperture valve system of FIG. 32, wherein the intake and exhaust floaters are shown at a position relative to, respectively, the intake and exhaust ports in response to the computerized control system of FIG. 47 for providing a "cruise" mode of operation of the engine thereof.

FIG. 55 depicts an example of how the computer control system 400 has dynamically reconfigured aspiration of the combustion chamber 314 of an internal combustion engine operating in an automotive environment. In this regard, the lower head 310 and intake and exhaust floaters 306*a*, 306*b* are shown in typical instantaneous positions (the upper head and orbiter being removed for clarity), to provide for "cruise" operation, wherein the computerized control system 400 has located the secondary aperture 324*a* of the intake floater 306*a* with respect to the intake port 308 so that the intake floater occludes little of the intake port except at the leading end thereof by moving the floater clockwise via the stepper motor 372*a*, and has located the secondary aperture 324*b* of the exhaust floater 306*b* with respect to the exhaust port 312 so that the exhaust floater occludes the leading end of the exhaust port by moving the exhaust floater counterclockwise via the stepper motor 372*b*.

To those skilled in the art to which this invention appertains, the above described preferred embodiment may be subject to change or modification. In this regard, it is to be understood that the hereinabove described embodiments merely describe preferred examples of carrying out the present invention with respect to a reciprocating internal combustion engine. Accordingly, it is to be understood that the variable orbital aperture valve system according to the present invention is also applicable to any form of internal combustion engines, compressors, pumps and any other manner of fluid (gas or liquid) processing machines. In this regard further, the term "aspiration" as used herein means ability for a fluid, either gaseous or liquid, to move into and/or out of a fluid processing chamber. Such change or modification can be carried out without departing from the scope of the invention, which is intended to be limited only by the scope of the appended claims.

What is claimed is:

1. A variable orbital aperture valve system for a fluid processing machine, wherein the machine has at least one fluid processing chamber, each chamber having at least one port through which fluid passes into and out of the chamber, said variable orbital aperture valve system comprising:

an orbiter having at least one primary aperture therein;

means for mounting said orbiter adjacent a chamber of a fluid processing machine, wherein the chamber has at least one port, to thereby mount said orbiter rotatably with respect to the chamber in sealingly interfaced relation with respect to the at least one port;

means for rotating said orbiter with respect to the chamber to thereby provide periodic alignment of said at least one primary aperture with respect to the at least one port;

at least one floater having a secondary aperture therein;

means for mounting said at least one floater adjacent said orbiter to thereby mount said at least one floater movably in sealingly interfaced relation with respect to said orbiter and the at least one port; and means for selectively moving said at least one floater with respect to the at least one port so that said secondary aperture is selectively aligned with respect thereto wherein said secondary aperture remains substantially near said at least one port;

wherein fluid passes through the at least one port when the at least one primary aperture of said orbiter aligns therewith, and wherein said alignment of said at least one primary aperture with respect to the at least one port is selectively modified by the selective movement of said at least one floater due to repositioning of said at least one secondary aperture with respect to the at least one port.

2. The valve system of claim 1, wherein said means for selectively moving comprises:

actuator means for selectively moving said at least one floater with respect to the at least one port; and computer control means for controlling actuation of said actuator means to thereby selectively align said secondary aperture with respect to the at least port responsive to selected operating conditions of the machine.

3. A fluid processing machine comprising:

at least one fluid processing chamber having at least one port through which fluid passes into and out of said chamber; and a variable orbital aperture valve system for each said chamber, said variable orbital aperture valve system for each fluid processing chamber comprising:

an orbiter having at least one primary aperture therein;

means for mounting said orbiter adjacent said chamber to thereby mount said orbiter rotatably with respect to said chamber in sealingly interfaced relation with respect to said at least one port thereof;

means for rotating said orbiter with respect to said chamber to thereby provide periodic alignment of said at least one primary aperture with respect to said at least one port;

at least one floater having a secondary aperture therein;

means for mounting said at least one floater adjacent said orbiter to thereby mount said at least one floater movably in sealingly interfaced relation with respect to said orbiter and said at least one port; and means for selectively moving said at least one floater with respect to said at least one port so that said secondary aperture is selectively aligned with respect thereto wherein said secondary aperture remains substantially near said at least one port;

wherein fluid passes through said at least one port when said at least one primary aperture of said orbiter aligns there;with, and wherein said alignment of said at least one primary aperture with respect to said at least one port is selectively modified by the selective movement of said at least one floater due to repositioning of said second aperture thereof with respect to said at least one port.

4. The machine of claim 3, wherein said means for selectively moving comprises:

actuator means for selectively moving said at least one floater with respect to said at least one port; and computer control means for controlling actuation of said actuator means to thereby selectively align said secondary aperture with respect to said at least port responsive to selected operating conditions of the machine.

5. The machine of claim 4, wherein said at least one port of each said chamber comprises intake port means for providing passage of fluid into said chamber, and exhaust port means for providing passage of fluid out of said chamber.

6. The machine of claim 5, wherein selectively moving said at least one floater comprises selective modification of said periodic alignment to thereby modify at least one of: area of said intake port means, shape of said intake port means, area of said exhaust port means, shape of said exhaust port means, aspiration duration, aspiration timing, aspiration centerline, and intake and exhaust aspiration overlap.

7. The machine of claim 6, wherein said at least one primary aperture comprises a primary intake aperture for periodically aligning with said intake port means as said orbiter rotates with respect to said chamber, and a primary exhaust aperture for periodically aligning with said intake port means as said orbiter rotates with respect to said chamber.

8. The machine of claim 6, wherein said at least one floater comprises at least one floater located at at least one of said intake port means and said exhaust port means, wherein said secondary aperture thereof is selectively alignable with respect to said at least one of said intake port means and said exhaust port means.

9. The machine of claim 6, wherein said at least one floater comprises a floater located at said intake port means, wherein said secondary aperture thereof is selectively alignable with respect to said intake port means.

10. The machine of claim. 6, wherein said at least one floater comprises:

a first floater located at said intake port means, wherein said secondary aperture thereof is selectively alignable with respect to said intake port means; and a second floater located at said intake port means, wherein said secondary aperture thereof is selectively alignable with respect to said intake port means.

11. The machine of claim 6, wherein said at least one floater comprises:

an intake floater located at said intake port means, wherein said secondary aperture thereof is selectively alignable with respect to said intake port means; and an exhaust floater located at said exhaust port means, wherein said secondary aperture thereof is selectively alignable with respect to said exhaust port means.

12. A method for providing dynamic control of aspiration of a fluid processing machine, wherein the machine has at least one chamber having at least one port through which fluid enters and leaves the chamber, said method comprising the steps of:

rotating an orbiter having at least one primary aperture therein with respect to a chamber of a fluid processing machine, wherein the chamber has at least one port, to thereby provide periodic alignment of the at least one primary aperture with respect to the at least one port, wherein the periodic alignment provides periodic aspiration of the chamber of the fluid processing machine; and selectively moving at least one floater having a secondary aperture therein with respect to the at least one port so as to selectively align the secondary aperture with respect to the at least one port wherein said secondary aperture remains substantially near the at least one port to thereby provide selective modification of the periodic alignment;

wherein the selective modification of the periodic alignment provides dynamic control of the aspiration of the fluid processing machine.

13. The method of claim 12, wherein said step of selectively moving said at least one floater comprises selective modification of at least one of: area of the at least one port, shape of the at least one port, aspiration duration, aspiration timing, aspiration centerline, and intake and exhaust aspiration overlap.

14. The method of claim 12, wherein the at least one port comprises intake port means for providing intake aspiration of the chamber and exhaust port means for providing exhaust aspiration of the chamber, said step of selectively moving comprising:

selectively moving the at least one floater so that the secondary aperture thereof is selectively aligned with at least one of the intake port means and the exhaust port means.

15. The method of claim 12, wherein the at least one port comprises intake port means for providing intake aspiration of the chamber and exhaust port means for providing exhaust aspiration of the chamber, said step of selectively moving comprising:

selectively moving a floater having a secondary aperture therein so as to selectively align the secondary aperture with the intake port means.

16. The method of claim 12, wherein the at least one port comprises intake port means for providing intake aspiration of the chamber and exhaust port means for providing exhaust aspiration of the chamber, said step of selectively moving comprising:

selectively moving a first floater having a first secondary aperture therein so as to selectively align the first secondary aperture with the intake port means; and selectively moving a second floater having a second secondary aperture therein so as to selectively align the second secondary aperture with the intake port means.

17. The method of claim 12, wherein the at least one port comprises intake port means for providing intake aspiration of the chamber and exhaust port means for providing exhaust aspiration of the chamber, said step of selectively moving comprising:

selectively moving an intake floater having an intake secondary aperture therein so as to selectively align the intake secondary aperture with the intake port means; and selectively moving an exhaust floater having an exhaust secondary aperture therein so as to selectively align the exhaust secondary aperture with the exhaust port means.

18. An internal combustion engine comprising:

at least one combustion chamber for providing an enclosed space for combustion of a combustible gas, said combustion chamber having a head, said head having intake port means for providing entry into said combustion chamber of at least a gaseous component of the combustible gas, said head further having exhaust port means for providing exhaust of combusted gas from said combustion chamber;

piston means fluidically communicating with said combustion chamber for providing movement of a piston in response to combustion of the combustible gas within said combustion chamber, and for providing rotation of a shaft in response to said movement of said piston;

ignition means for providing periodic combustion of the combustible gas within the combustion chamber responsively to movement of said piston; and a variable orbital aperture valve system for providing periodic aspiration of said combustion chamber via said intake and exhaust port means timed responsively to movement of said piston, comprising:

an orbiter having at least one primary aperture therein;

means for mounting said orbiter to said head to thereby mount said orbiter rotatably with respect to said head in sealingly interfaced relation with respect to said intake and exhaust port means;

means for rotating said orbiter with respect to said head to thereby provide periodic alignment of said at least one primary aperture with said intake and exhaust port means;

at least one floater having a secondary aperture therein;

means for mounting said at least one floater adjacent said orbiter to thereby mount said at least one floater movably in sealingly interfaced relation with respect to said orbiter and at least one of said intake and exhaust port means; and means for selectively moving said at least one floater with respect to at least one of said intake and exhaust port means wherein said secondary aperture remains substantially near thereto so that said secondary aperture is selectively aligned with respect thereto;

wherein at least a gaseous component of the combustible gas passes into said combustion chamber through said intake port means when said at least one primary aperture of said orbiter aligns therewith, wherein combusted gas passes out of said combustion chamber through said exhaust port means when said at least one primary aperture of said orbiter aligns therewith, and wherein at least one of said alignments is selectively modified by the selective movement of said at least one floater due to repositioning of said secondary aperture thereof with respect to at least one of said intake and exhaust port means.

19. The internal combustion engine of claim 18, wherein said means for rotating and said means for selectively moving comprise:

drive connection means for transferring rotation of said shaft into rotation of said orbiter;

actuator means for selectively moving said at least one floater with respect to said at least one of said intake and exhaust port means; and computer control means for controlling actuation of said actuator means to thereby selectively align said secondary aperture with respect to said at least one of said intake and exhaust port means responsive to selected operating conditions of the internal combustion engine.

20. The internal combustion engine of claim 19, wherein said at least one floater comprises at least one floater located at at least one of said intake port means and said exhaust port means, wherein said secondary aperture thereof is selectively alignable with respect to said at least one of said intake port means and said exhaust port means.

21. The internal combustion engine of claim 20, wherein selectively moving said at least one floater comprises selective modification of at least one of the periodic alignments to thereby modify at least one of area of said intake port means, shape of said intake port means, area of said exhaust port means, shape of said exhaust port means, aspiration duration, aspiration timing, aspiration centerline, and intake and exhaust aspiration overlap.

22. The internal combustion engine of claim 21, wherein said at least one primary aperture comprises a primary intake aperture for periodically aligning with said intake port means as said orbiter rotates with respect to said head, and a primary exhaust aperture for periodically aligning with said exhaust port means as said orbiter rotates with respect to said head.

23. The internal combustion engine of claim 19, wherein said at least one floater comprises a floater located at said intake port means, wherein said secondary aperture thereof is selectively alignable with respect to said intake port means.

24. The internal combustion engine of claim 23, wherein selectively moving said floater comprises selective modification of the periodic alignment of said primary intake aperture with said intake port means to thereby modify at least one of: area of said intake port means, shape of said intake port means, aspiration duration, aspiration timing, aspiration centerline, and intake and exhaust aspiration overlap.

25. The internal combustion engine of claim 24, wherein said at least one primary aperture comprises a primary intake aperture for periodically aligning with said intake port means as said orbiter rotates with respect to said head, and a primary exhaust aperture for periodically aligning wish said exhaust port means as said orbiter rotates with respect to said head.

26. The internal combustion engine of claim 19, wherein said at least one floater comprises:

a first floater located at said intake port means, wherein said secondary aperture thereof is selectively alignable with respect to said intake port means; and a second floater located at said intake port means, wherein said secondary aperture thereof is selectively alignable with respect to said intake port means.

27. The internal combustion engine of claim 26, wherein selectively moving said first and second floaters comprises selective modification of the periodic alignment of said primary intake aperture of said orbiter with said intake port means to thereby modify at least one of: area of said intake port means, shape of said intake port means, aspiration duration, aspiration timing, aspiration centerline, and intake and exhaust aspiration overlap.

28. The internal combustion engine of claim 27, wherein said at least one primary aperture comprises a primary intake aperture for periodically aligning with said intake port means as said orbiter rotates with respect to said head, and a primary exhaust aperture for periodically aligning with said exhaust port means as said orbiter rotates with respect to said head.

29. The internal combustion ,engine of claim 19, wherein said at least one floater comprises:

an intake floater located at said intake port means, wherein said secondary aperture thereof is selectively alignable with respect to said intake port means; and an exhaust floater located at said exhaust port means, wherein said secondary aperture thereof is selectively alignable with respect to said exhaust port means.

30. The internal combustion engine of claim 29, wherein selectively moving said intake and exhaust floaters comprises selective modification of at least one of the periodic alignments to thereby modify at least one of: area of said intake port means, shape of said intake port means, area of said exhaust port means, shape of said exhaust port means, aspiration duration, aspiration timing, aspiration centerline, and intake and exhaust aspiration overlap.

31. The internal combustion engine of claim 30, wherein said at least one primary aperture comprises a primary intake aperture for periodically aligning with said intake port means as said orbiter rotates with respect to said head, and a primary exhaust aperture for periodically aligning with said exhaust port means as said orbiter rotates with respect to said head.

32. The internal combustion engine of claim 19, wherein said at least one floater comprises at least one floater located at said intake port means, wherein said secondary aperture thereof is selectively alignable with respect to said intake port means; said at least one floater further having at least one hole therein adjacent said secondary aperture thereof for providing high velocity flow of gas entering into said combustion chamber through said intake port means.

* * * * *